US006382433B1

(12) United States Patent
Podergois

(10) Patent No.: US 6,382,433 B1
(45) Date of Patent: May 7, 2002

(54) FOLDABLE DISPLAY ASSEMBLY

(75) Inventor: Jeffrey A. Podergois, Chanhassen, MN (US)

(73) Assignee: Vengra Design Group, Inc., Chanhassen, MN (US)

( * ) Notice: Subject to any disclaimer, the term of this patent is extended or adjusted under 35 U.S.C. 154(b) by 0 days.

(21) Appl. No.: 09/669,074

(22) Filed: Sep. 25, 2000

(51) Int. Cl.[7] ..... A47F 5/00

(52) U.S. Cl. ..... 211/195; 40/539; 40/605; 40/610; 248/174

(58) Field of Search ..... 211/195, 132.1, 211/149; 248/174; 40/539, 605, 610; 160/135

(56) References Cited

U.S. PATENT DOCUMENTS

| | | | | |
|---|---|---|---|---|
| 1,852,471 | A | | 4/1932 | Nelson |
| 2,049,231 | A | | 7/1936 | Storch |
| 2,125,784 | A | | 8/1938 | Higgins |
| 2,142,547 | A | * | 1/1939 | Anderson |
| 2,142,548 | A | * | 1/1939 | Anderson |
| 2,240,024 | A | | 4/1941 | Stone |
| 2,373,778 | A | | 4/1945 | Quinby |
| 2,679,997 | A | | 6/1954 | Harris |
| 2,824,395 | A | | 2/1958 | Decker |
| 3,113,392 | A | | 12/1963 | Downing |
| 3,559,814 | A | | 2/1971 | Downing |
| 3,601,916 | A | | 8/1971 | Epstein |
| 3,606,230 | A | | 9/1971 | Hargreaves |
| 3,766,675 | A | | 10/1973 | Leigh |
| 3,987,737 | A | | 10/1976 | Smith |
| 4,068,398 | A | | 1/1978 | Parisi |
| 4,226,040 | A | * | 10/1980 | Carroll et al. |
| 4,319,688 | A | | 3/1982 | Wahl |
| 4,428,136 | A | | 1/1984 | Franklin |
| 4,655,352 | A | | 4/1987 | Noyes |
| 4,657,149 | A | | 4/1987 | Masson |
| 4,991,813 | A | | 2/1991 | Beaulieu |
| 5,293,705 | A | * | 3/1994 | Wood ..... 40/539 X |
| 5,388,382 | A | | 2/1995 | Brooks |
| 5,483,779 | A | | 1/1996 | Crawford |
| 5,632,390 | A | | 5/1997 | Podergois |
| 5,810,182 | A | | 9/1998 | Levin |
| 5,907,917 | A | * | 6/1999 | Bicker ..... 40/539 X |
| 5,957,310 | A | | 9/1999 | Mitchell |
| 5,960,848 | A | | 10/1999 | Schirer |
| 5,961,365 | A | | 10/1999 | Lambert |
| 6,085,452 | A | * | 7/2000 | Davis |

* cited by examiner

*Primary Examiner*—Robert W. Gibson, Jr.
(74) *Attorney, Agent, or Firm*—Gray, Plant, Mooty, Mooty & Bennett, P.A.

(57) ABSTRACT

A display assembly constructed primarily of fluted plastic material comprising two triangular vertical end columns, a center wall between the columns, and a header extending between the tops of the two end columns to provide lateral stability and additional display area. If desired, one or more middle columns may be added to widen the display area. The display is manufactured to be delivered to the user in a flat knocked-down folded condition. The display is designed to be easily assembled by the user at the point of use without any tools or connectors other than those that are a part of and integral to the fluted plastic panels which are assembled to form the display. Fabric may or may not be laminated to the vertical end and/or middle columns; if not, use of translucent plastic materials for such columns permits internal back-lights to be used. Optional extension columns may also be attached to the end columns to widen the display area.

55 Claims, 25 Drawing Sheets

FOLDABLE DISPLAY ASSEMBLY

FIELD OF THE INVENTION

The invention relates generally to foldable display assemblies and more particularly to lightweight portable display assemblies constructed of a fluted plastic product.

BACKGROUND

Trade shows are an increasingly used means for vendors of products to advertise their goods and services to the trade. These shows are held worldwide and attract vendors, buyers, and resellers from far flung geographic areas. Large sums of money are spent by vendors to display their products in an eye catching manner. Generally, the vendor either purchases or makes a display assembly and ships it to the trade show where it is assembled. After the show the display is disassembled and shipped back to the vendor's place of business where it is stored until the next trade show. It is not uncommon for a vendor to attend multiple trade shows annually.

The display assemblies commonly available are expensive to purchase or construct, ship, assemble, disassemble, and store. The expense associated with them is due to their weight and large unwieldy size, and the materials from which they are constructed. Generally, displays are constructed of heavy hard to work materials such as wood and metal. They are fastened together with common fasteners such as screws staples, pins, and metal rods. The displays are knocked down for shipment to the trade show location and often require skilled labor to assemble. Some trade show displays may be knocked down for shipment as luggage, but they generally must be shipped in multiple packages due to the fact that they consist of a sheet material and a separate frame structure. The bulky frame structure alone may require shipment in multiple packages.

SUMMARY OF THE INVENTION

The invention provides an improvement in currently available display assemblies. It comprises two triangular shaped end columns which support a center wall centrally disposed between the end columns. If it is desired to widen the display area, one or more middle columns, similar in construction to the end columns, may be added. The center wall is engaged along its vertical edges with each of the end and/or middle columns by tabs extending from each vertical edge of the center wall and inserted into corresponding slots on the end and/or middle columns in a locking arrangement. The locking slot and tab arrangement provide a butted joint between the columns and the center wall, which provide a strong and rigid interlock between the center wall and the columns as well as providing vertical stability of the entire display assembly.

Further locking engagement of the center wall between the columns is provided by a header member that extends between two adjacent columns. The header locks into each column by the engagement of a slot on the header with the top of a vertical wall of each column.

The display is constructed of fluted plastic with or without fabric laminated to it. The fluted plastic material allows the display to be made light weight and to be of modular construction. It also allows the parts of the display to be folded and packed flat in a small easily portable point of sale container. The point of sale container may be inexpensively shipped and stored. The material has the advantage of being inexpensively die cut and creased. A particular advantage of the material is that it is a one piece material that may nonetheless be cut almost entirely through its thickness to form a "cut hinge."

The interconnection of the parts of the display is accomplished entirely by insertion of die cut tabs and slots. No other fasteners are required. Strength and rigidity of the display is also entirely a function of the folding and interlocking of the parts of the display. No other materials are used to accomplish this purpose. Creasing of the fluted material to form fold lines during manufacture of the display parts allows for straight and properly aligned folds during assembly.

Triangular or rectangular construction of the columns, and overlapping of the fluted material with mating tabs and slots, provides strength and stability. The center wall is additionally strengthened by horizontal and vertical ribs formed by folding the center wall section along preformed fold lines. Added rigidity and an aesthetic look is provided by a header attached horizontally from the top of a first end column extending to the top of a second end column. If fabric is not used on the columns, the translucent nature of the fluted plastic material permits installation of lights within the columns, thus providing backlighting to whatever images may be applied to the exterior of the columns.

The front of the display is similarly laminated with fabric to provide a professional appearance. The entire display may also be impregnated during manufacture with a fire retardant additive.

The entire display assembly is packed in a point of sale container in a knocked down flat condition.

BRIEF DESCRIPTION OF THE DRAWING

FIG. 7A shows an end column without fabric partially unfolded after taking it out of the point of sale container. FIGS. 7B and 7C show two stages of assembly of the end column of FIG. 7A.

DETAILED DESCRIPTION

Figure 1:
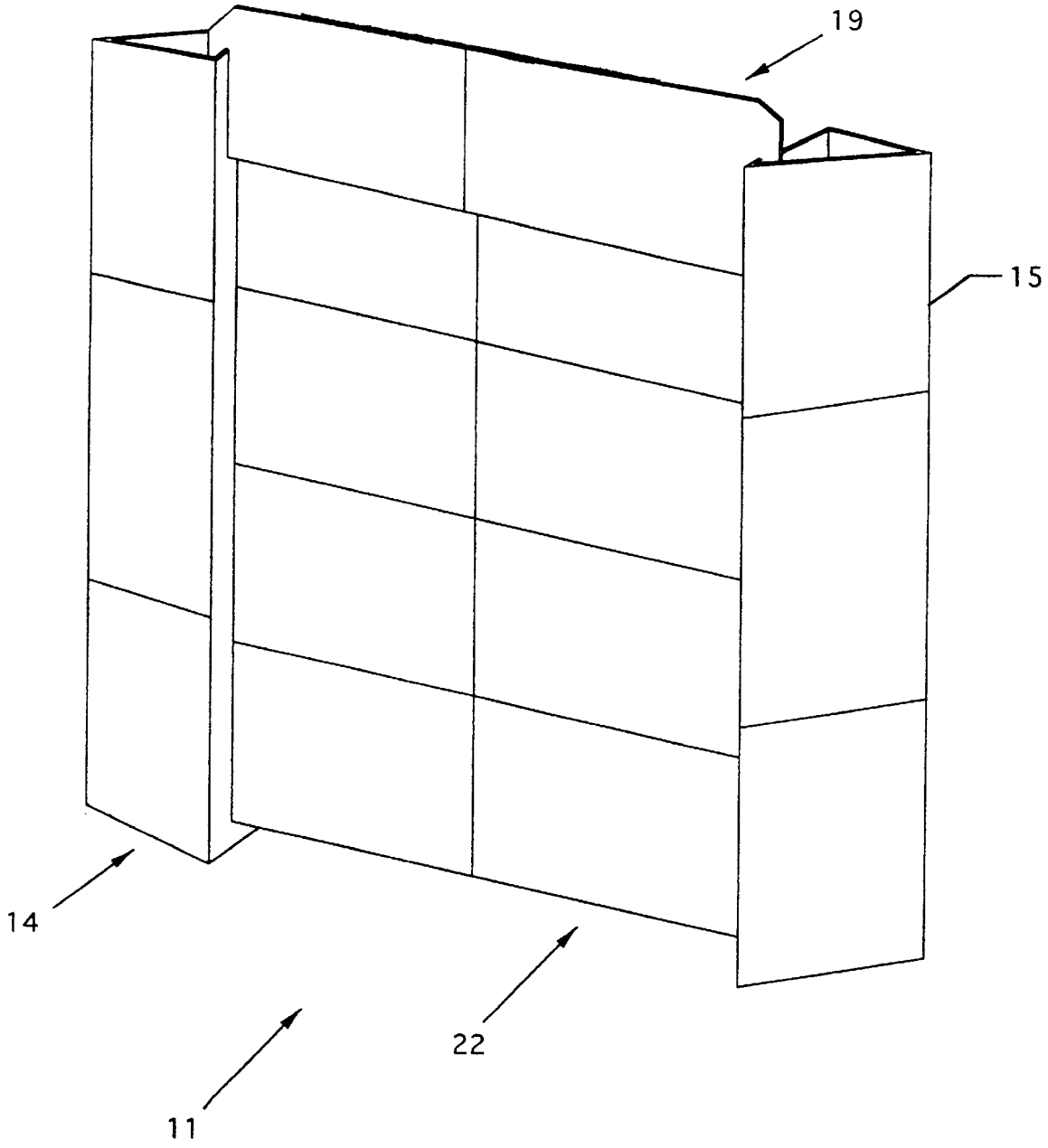
FIG. 1 is a perspective view of the front of one embodiment of the display assembly.

Referring now to the drawings, FIG. 1 depicts the front of my fully assembled portable knock-down display assembly ready to provide a background display at sales meetings, conventions, trade shows, and the like. The display assembly is constructed in accordance with the principles of the invention and is generally designated by the numeral 11. Display assembly 11 comprises upstanding, laterally spaced apart, triangular first end column and second end column 14 and 15. The end columns stabilize the display assembly 11 and support between them a center wall 22 with a front face, as shown in FIG. 1, which may optionally be attractively laminated with fabric to give the display a professional look associated with more expensive displays. The center wall is the primary viewing area for displayed materials. The front facing side, which is disposed at an angle to the center wall 22, of the end columns 14 and 15 also serves as a display area. This area is viewable as the display is approached from the side such is often the case at trade shows where displays are arranged in rows. Also supported between the end columns 14 and 15 is a header 19, providing further lateral support as well as a viewing area for displayed materials. Both the center wall 22 and the header 19 form the front viewing surface of the display 11. The end columns and center sections could be laminated with a fabric or left alone.

If a fabric is used, it is preferably laminated in place by adhering it to the fluted plastic material with an adhesive. Equivalent techniques include thermal bonding, ultrasonic welding, and the like. It may be necessary, and in any event is preferred, to sew down the ends of the fabric to prevent fraying. Again, other equivalent techniques, such as thermally sealing the fabric ends, are within the scope of the invention but not preferred.

Signs or other items to be displayed may be mounted on the display assembly with any traditional method, such as two way tape, hook-and-loop fasteners, pins, or adhesive.

Figure 2:
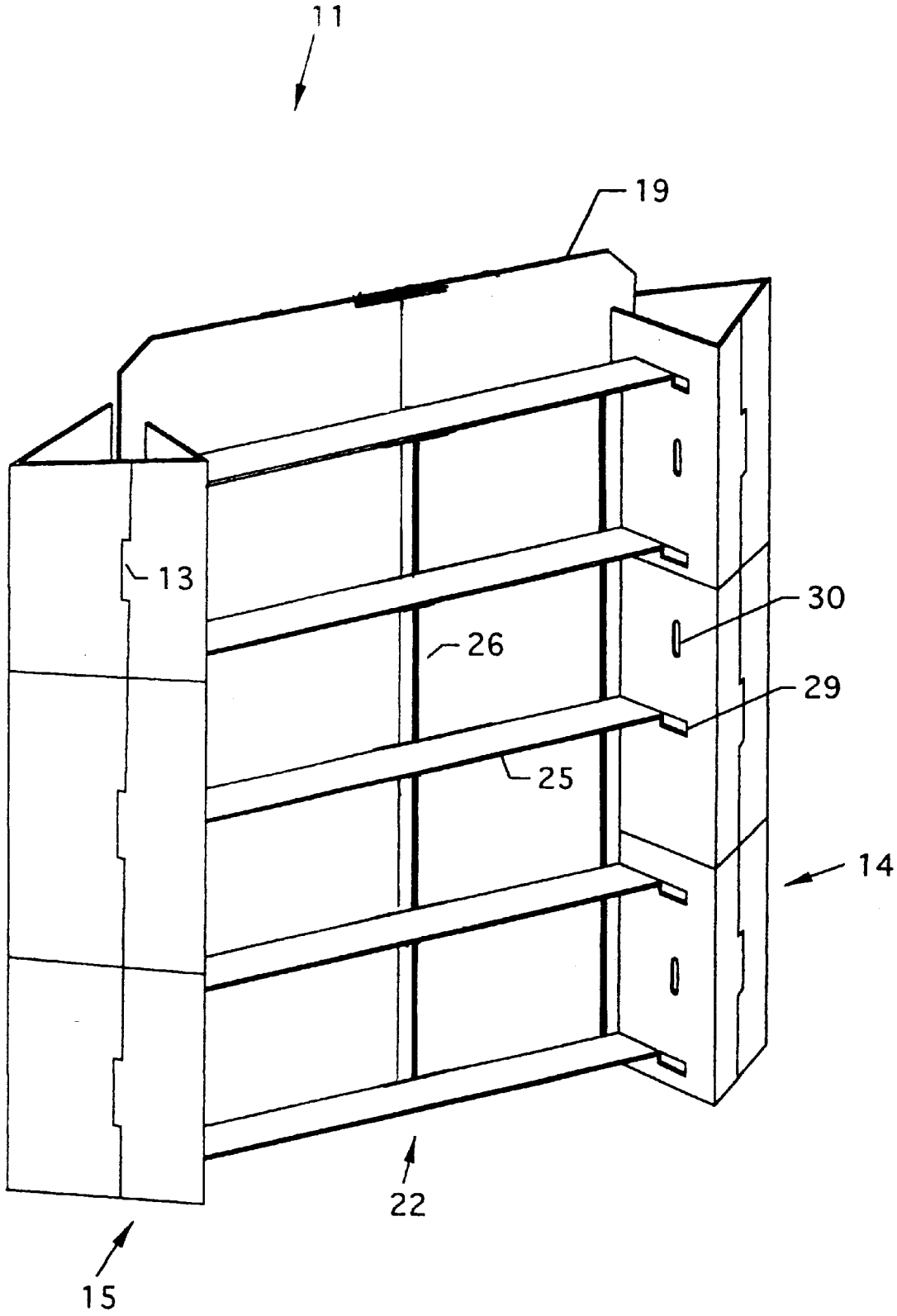
FIG. 2 is a perspective view of the back of the display assembly of FIG. 1.

FIG. 2 shows the back of the display assembly 11 illustrating, among other features of the display assembly, the center wall horizontal reinforcing ribs 25 and vertical ribs 26, respectively. Horizontal reinforcing ribs 25 are formed by folding the center wall section panels along integral "cut hinges," as will be described in more detail below. Vertical reinforcing ribs 26 are a separate material attached to the back of the center wall. The preferred material is aluminum, but any material having sufficient stiffness and strength to support the center wall is within the scope of the invention. Furthermore, incorporating a material into the wall itself is equivalent to attaching a separate material to the back of the wall, but it is not the preferred embodiment.

Figure 16:
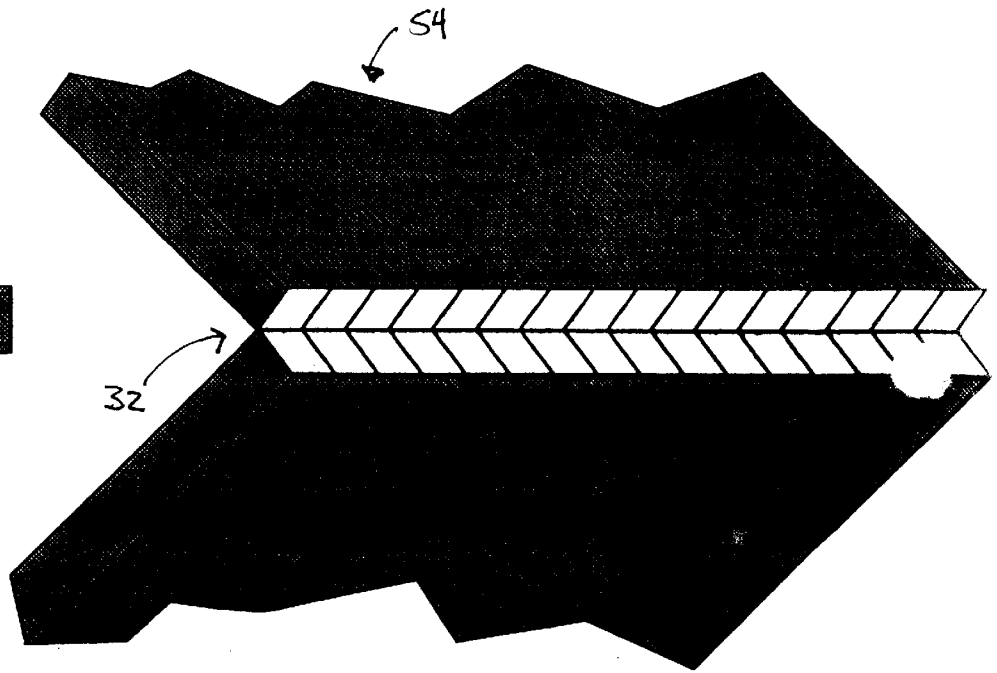
FIG. 16 is a perspective view of the material of FIG. 15 arranged to illustrate the cut hinge aspect of the invention.
Figure 15:
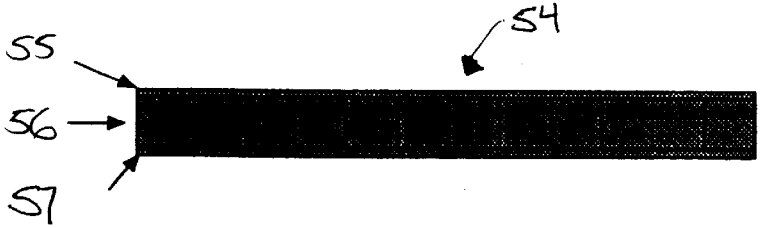
FIG. 15 is a cross sectional view of the fluted material used in the invention.

As previously stated, each of the end columns 14 and 15, the center wall sections 23, and the header 19 are die cut from heavy duty fluted plastic, thereby providing strength to the assembled display 11. FIG. 15 is a cross sectional view of this material, which is available from many vendors. Corrugated plastic material 54 comprises top layer 55, flutes 56, and bottom layer 57. As shown in FIG. 16, it is possible to cut through either (but not both) the top layer 55 or bottom layer 57 and flutes 56, leaving the other layer intact, to create a "cut hinge" in the material.

Figure 3A:
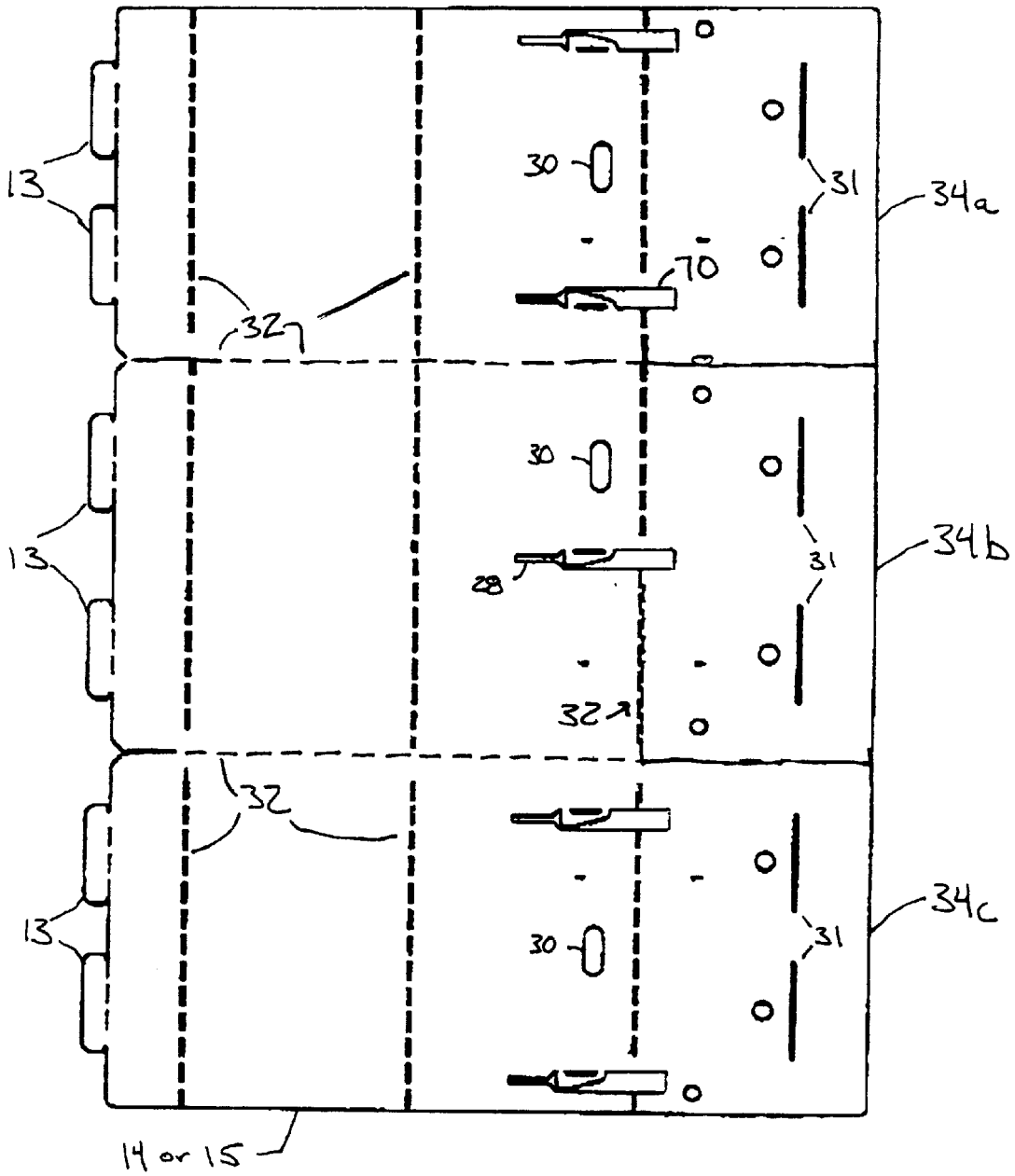
FIG. 3A is a plan view of an unfolded end column without laminated fabric.
Figure 3B:
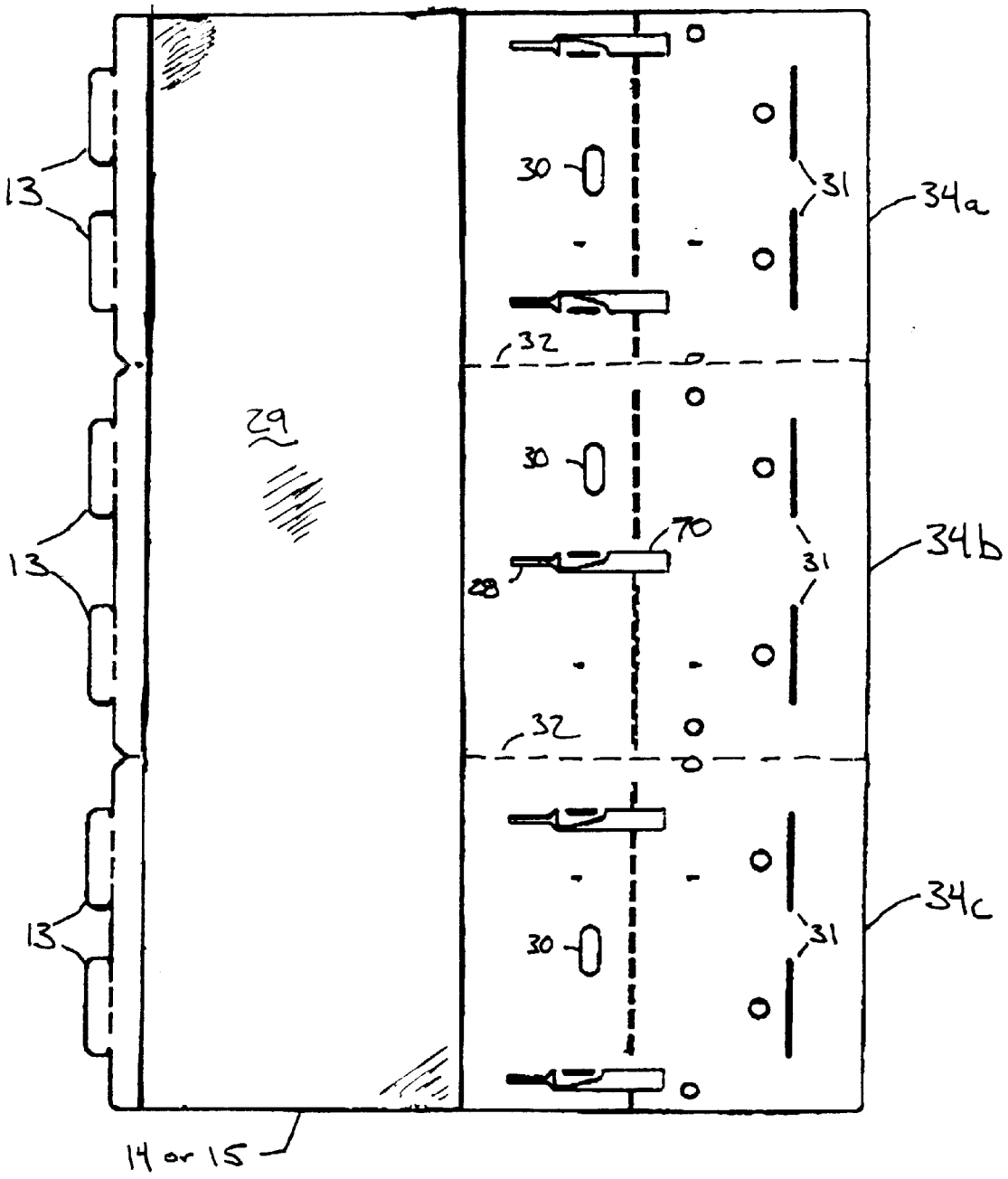
FIG. 3B is a plan view of an unfolded end column with laminated fabric.

FIG. 3A illustrates an end column in an unfolded flat condition as it is after being die cut. FIG. 3B shows an end column having the optional fabric 29 described above. Each end column is a unitary construction having three major segments connected by integral "cut hinges," as will be described in more detail below. Each end column segment 34*a*, 34*b*, and 34*c* has integrally connected tabs 13 for mating engagement with corresponding column slots 31. Each end column 14 and 15 has locking slots 28 each adjacent and in communication with its respective locking door 70. The number and location of tabs 13 and locking slots 28 are not critical to the scope of the invention. Hand holds 30 are cutout in each end column 14 and 15, for ease of assembly and carrying. The optional but preferred hand holds 30 are hidden from the viewer by the center wall 22 when the display 11 is fully assembled.

Figure 10:
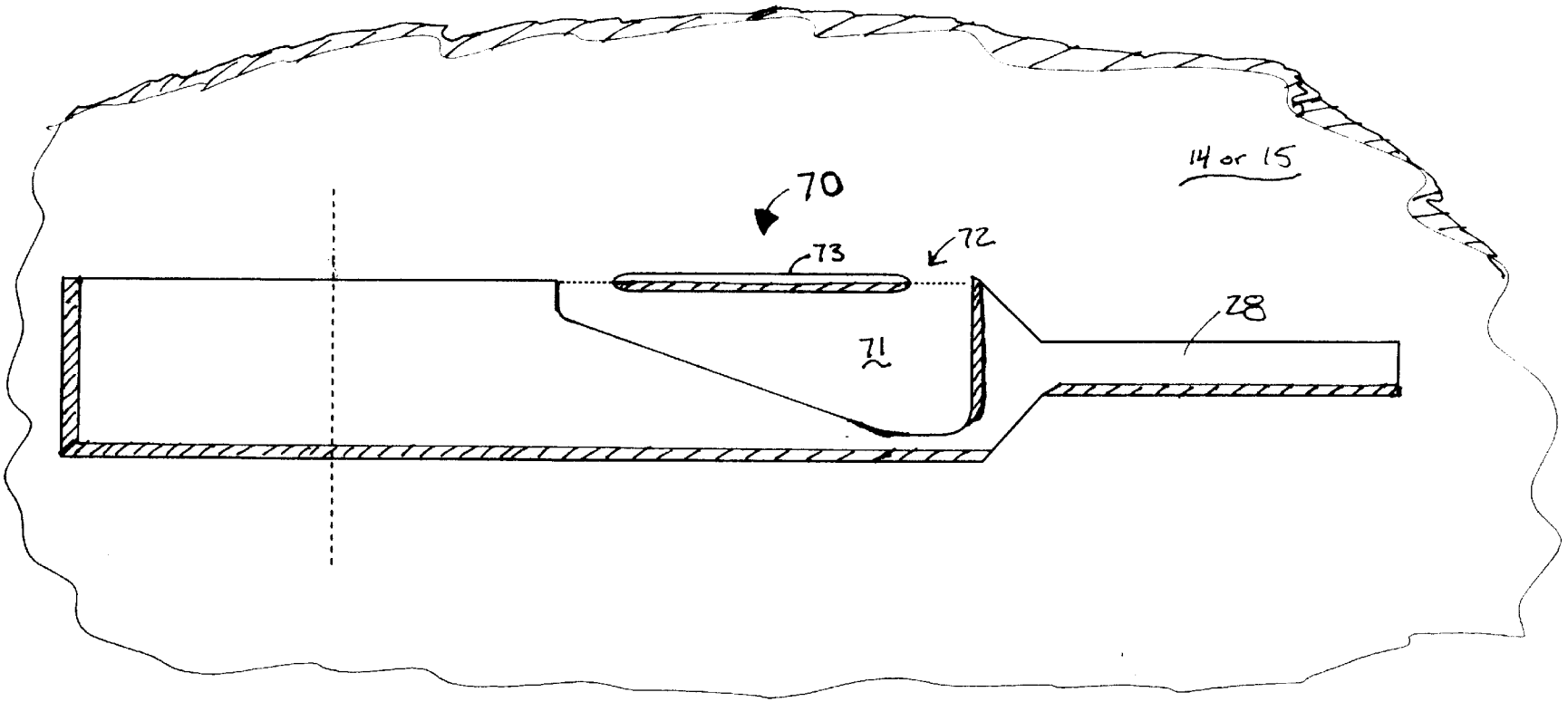
FIG. 10 is an partial cutout elevation view showing a locking door and center wall slot in an end column.

Locking door 70 is shown in detail in FIG. 10. The preferred embodiment of the locking door 70 includes a generally elongated (as shown, rectangular) opening in the fluted plastic end column. An angled tab portion 71 separates the wider portion of the opening from its respective locking slot 28. The hinge 72 of the locking door 70 preferably includes a cutout portion 73 that increases the ability of tab portion 71 to easily fold into the center of the end column. Due to the nature of the fluted plastic material, the tab portion 71 springs back to its original flush position with the wall of the end column 14 and 15 when the force depressing it inward is released. Thus, during assembly of the display 11 by the user, the center section end tabs 52 may be inserted into the wider portion of the opening, pushed past tab portion 71 into the narrower locking slots 28, and then tab portion 71 will spring back into place and lock center section end tab 52 in place within locking slot 28. Assembly of the display 11 will be more fully described in the text to follow.

Figure 6A:
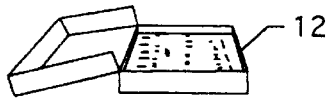
FIGS. 6A through 6D are perspective views of a display in various stages of assembly.
Figure 6B:
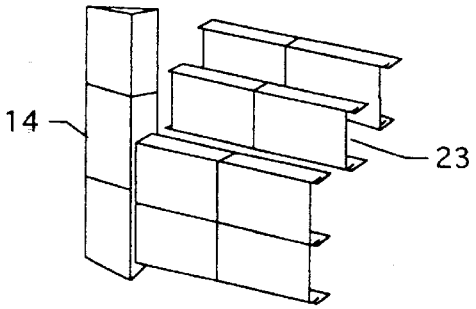
Figure 6C:
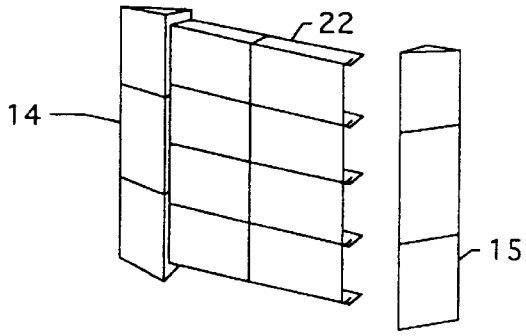
Figure 6D:
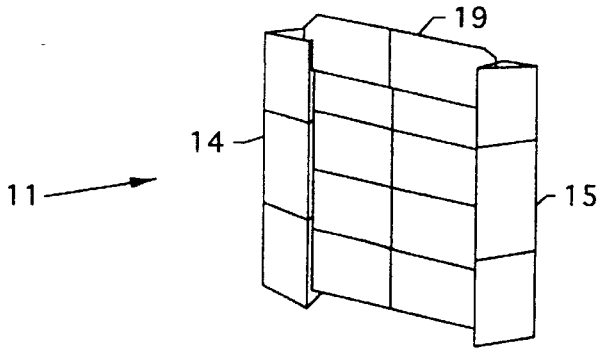
Figure 7A:
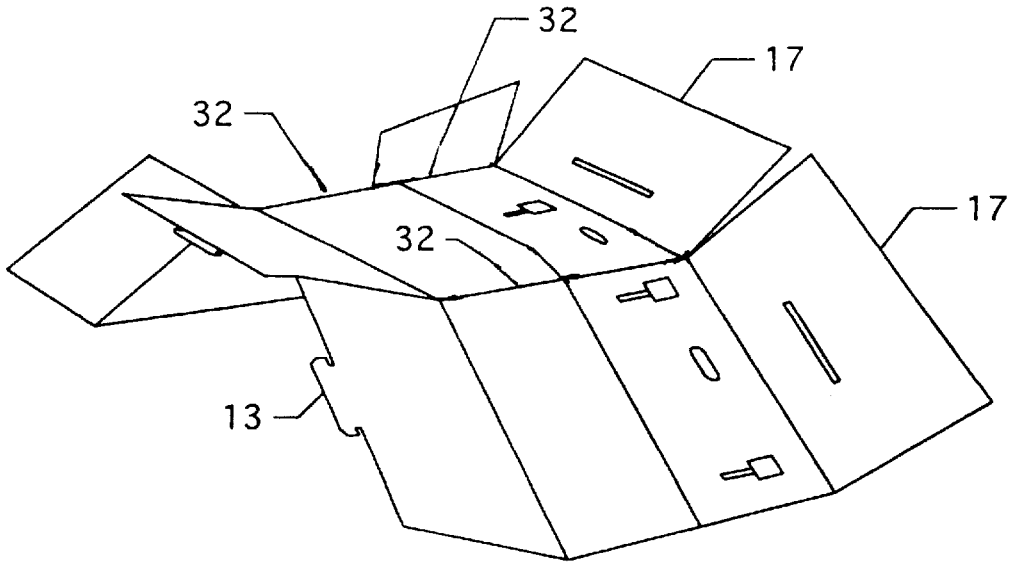
FIGS. 7A, 7B, and 7C are perspective views.
Figure 7B:
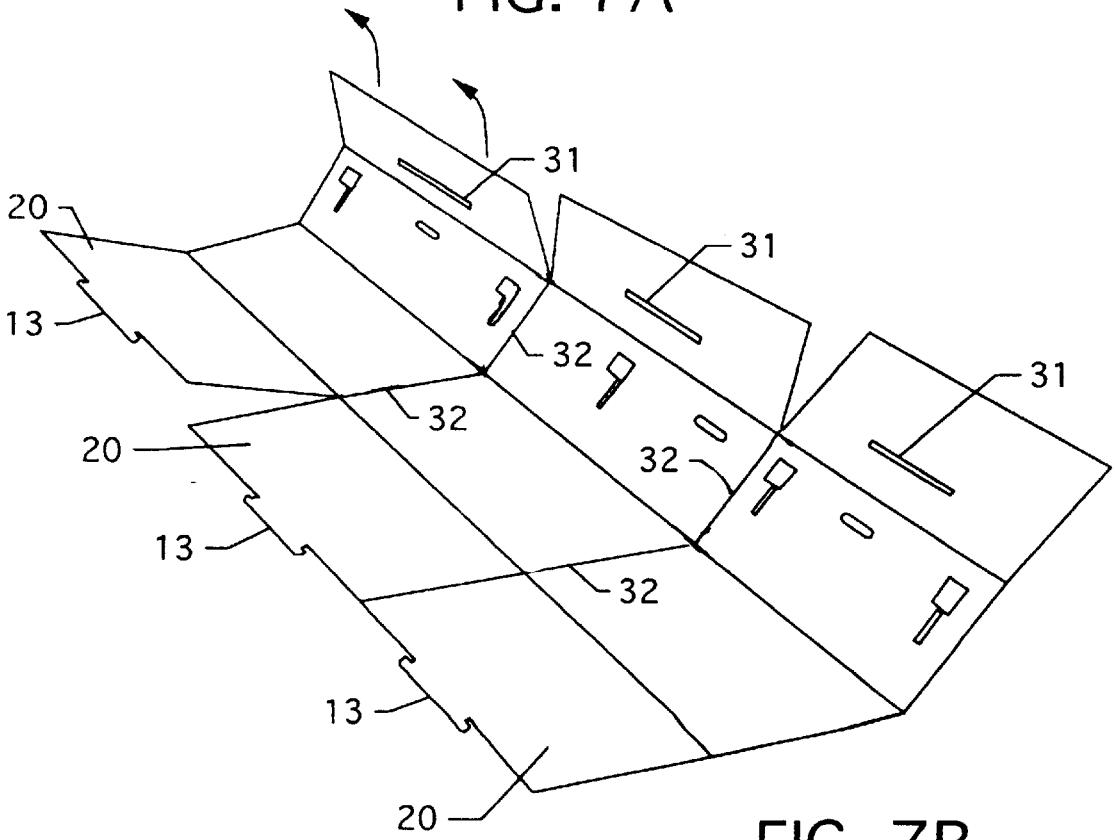
Figure 7C:
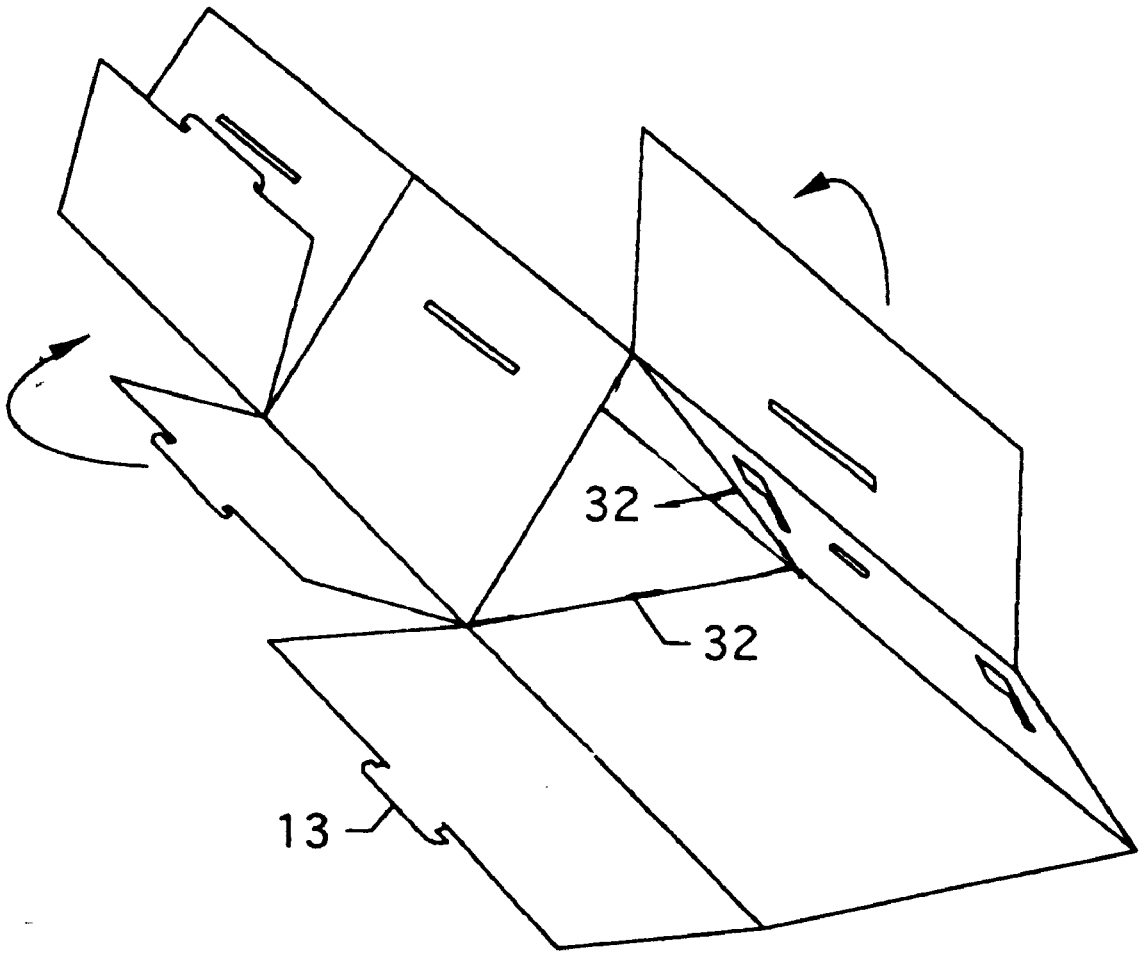

FIGS. 7A, 7B, and 7C illustrate the assembly steps of an end column 14 or 15. Beginning with FIG. 7A, a folded end column 14 or 15 is taken from its point of sale container 12, shown in FIG. 6A, and unfolded on a clean floor with the finish side, or exterior side, of the end column 14 or 15 towards the floor. In FIG. 7B, slotted panels 17 are rolled over along longitudinal fold lines and tucked under tabbed panels 20. Tabs 13 are inserted into slots 31 to form a rigid column, as shown in FIG. 7C.

Figure 20A:
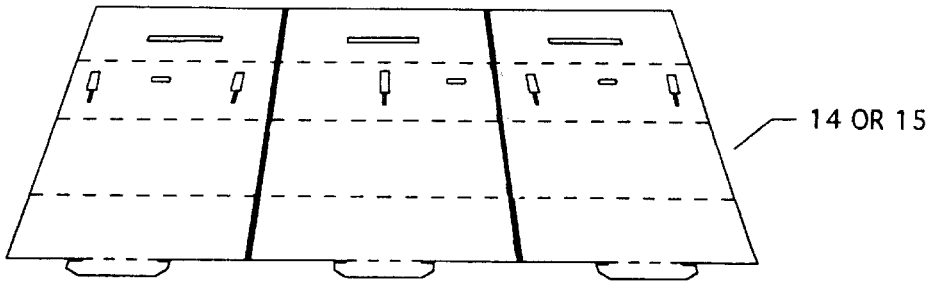
FIGS. 20A through 20E are perspective views showing various stages of refolding an end column for placement in the point of sale container.

FIGS. 7A, B, and C each illustrate cut hinges 32 between adjacent end column segments 34*a*, 34*b*, and 34*c*. Each end column is folded as shown in FIGS. 20A through 20E for shipment in its point of sale container 12. FIG. 20A shows an end column 14 or 15 on the floor with the finish side up.

Figure 20B:
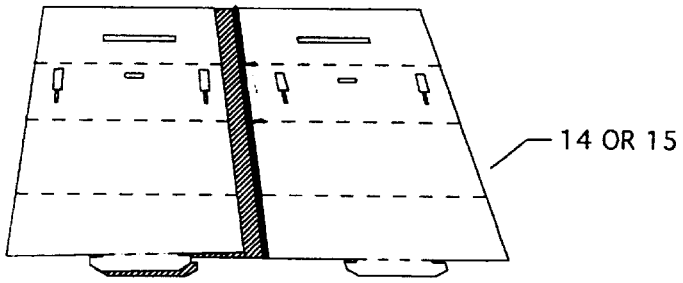
Figure 20C:
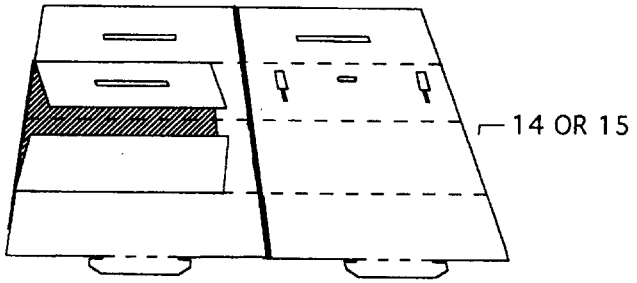
Figure 20D:
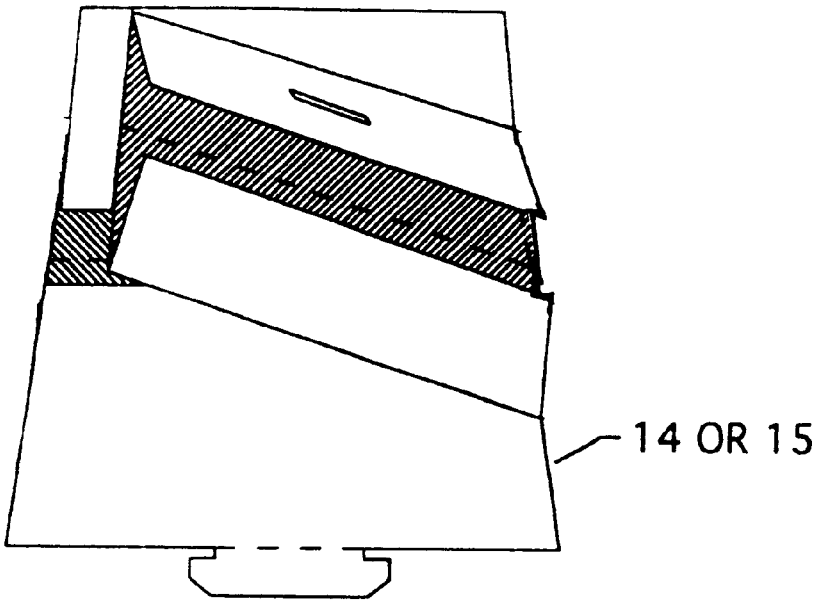
Figure 20E:
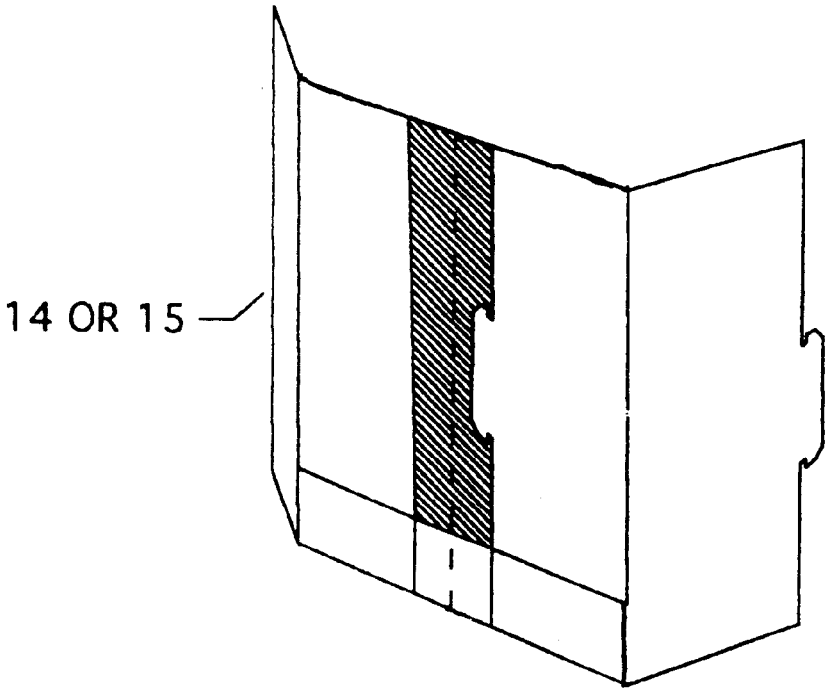

The end column is folded beginning with FIG. 20B and ending with FIG. 20E.

Figure 4A:
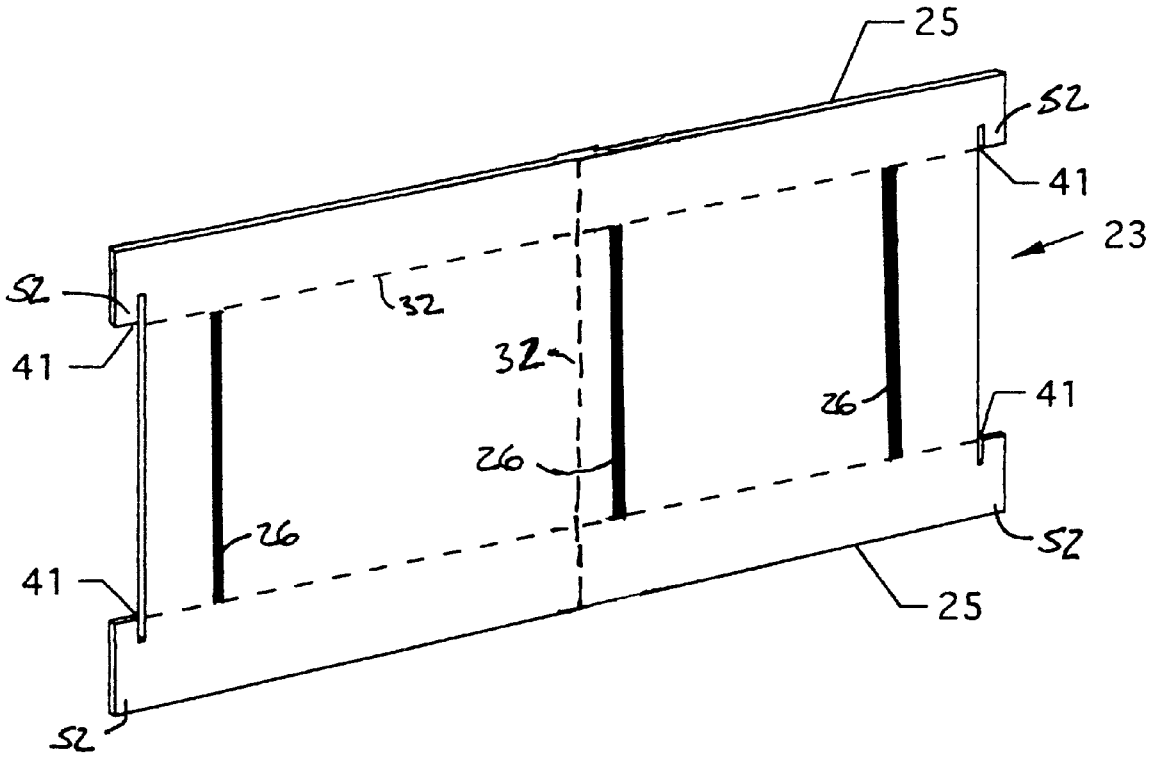
FIG. 4A is perspective view of the back of a center wall section.
Figure 4B:
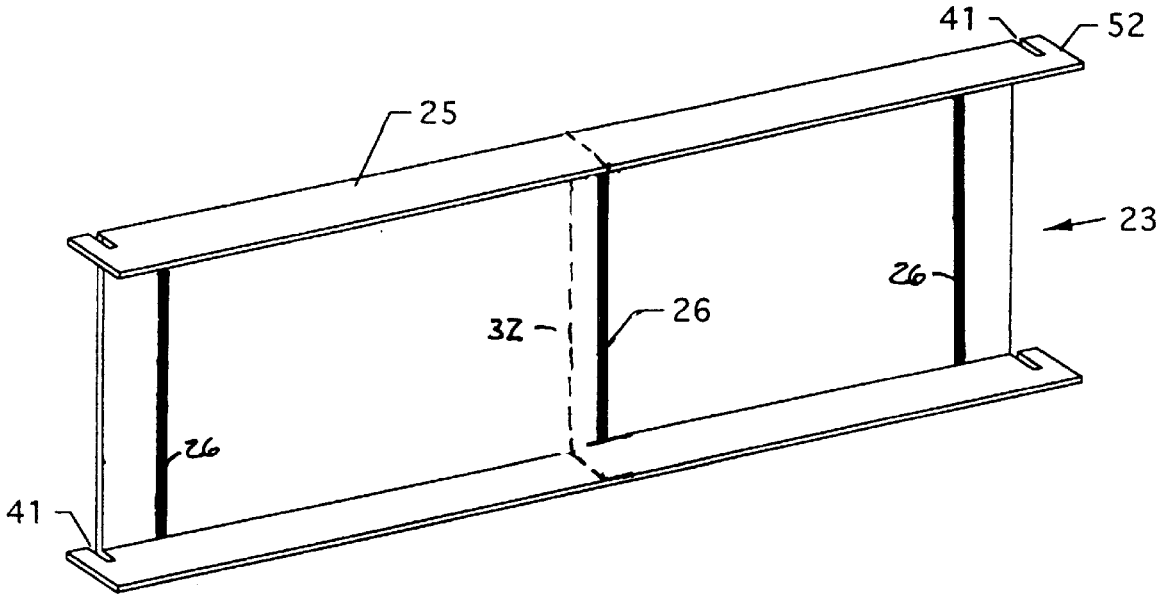
FIG. 4B is a perspective view of the center wall section of FIG. 4A as fully assembled.
Figure 17:
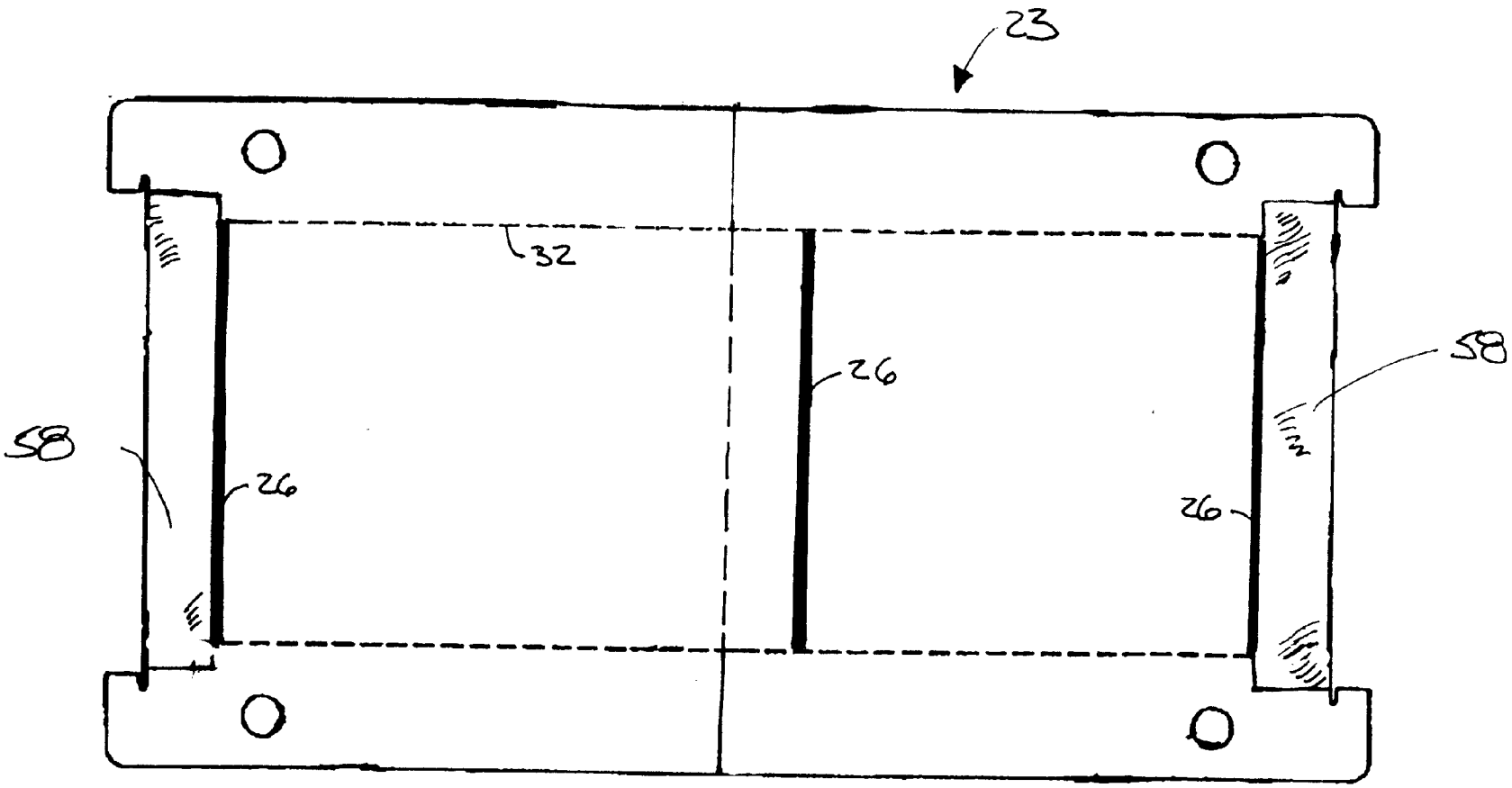
FIG. 17 is a plan view of an unfolded center wall section with laminated fabric.

FIGS. 4A and 4B show center wall section panels 23. FIG. 4A shows an unfolded center section 23. FIG. 4B illustrates a folded center section 23 as viewed from the back. Each center section has elongated notches 41 that engage with locking slots 28 on the end columns 14 and 15 when the display is assembled. To ensure a snug fit, the width of elongated notch 41 is slightly less than the thickness of the fluted plastic material out of which the display 11 is constructed. FIG. 17 shows a variation on FIG. 4A, specifically a center section 23 having lamintated fabric 58 as described above.

Figure 5:
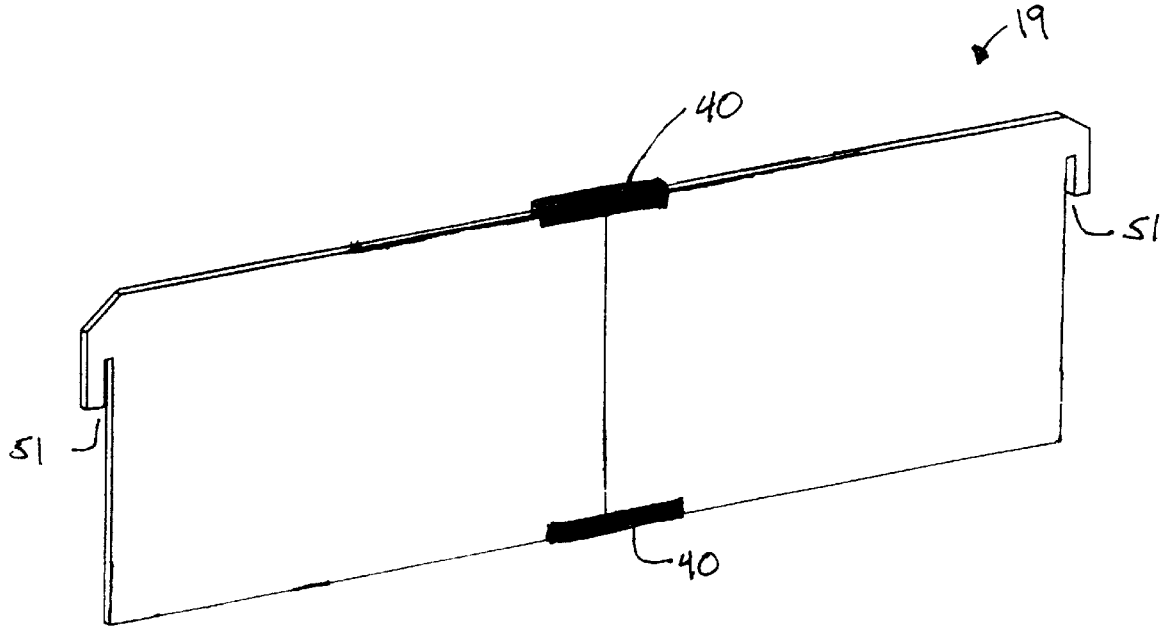
FIG. 5 is a perspective view of the back of the header.

The header 1 9, as shown in FIG. 5 from the back in assemble d form, serves as a part of the display area and as a lateral support member. The display area on the front of the header 19 is especially adaptable for placement of a banner indicating the name of the trade show participant. Each end of header 19 has header slots 51, which will be explained below in connection with the instructions for assembly of the display 11. To ensure a snug fit, the width of header slot 51 is slightly less than the thickness of the fluted plastic material out of which the end columns 14 and 15 are constructed. Header 19 need not be fluted plastic material, and thus the preferred material is a lightweight foam such as those manufactured from polyvinylchloride (PVC). A joint support piece 40 helps the assembled header 19 remain flat over its entire length. A preferred material for joint support piece 40 a is plastic three-sided, rectangular channel that fits snugly to the thickness of header 19. A support piece may be used at either the top of bottom of header 19, or both (as illustrated).

Figure 8:
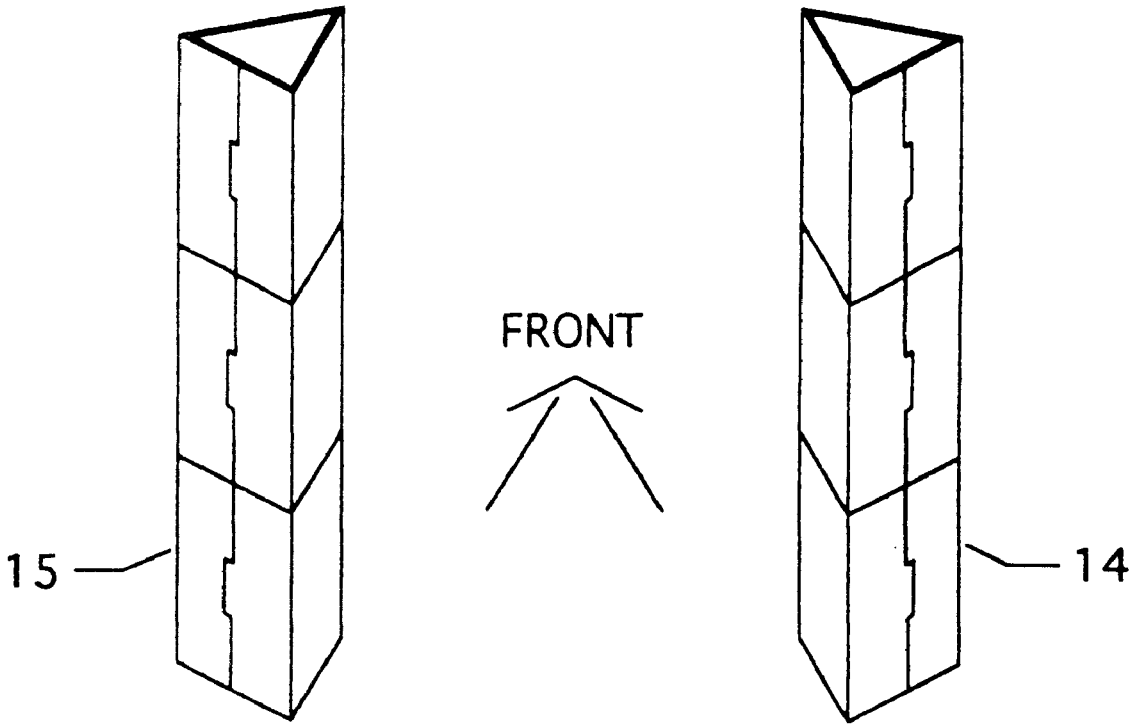
FIG. 8 is a perspective view of two assembled end columns showing their position relative to one another in a fully assembled display.
Figure 9:
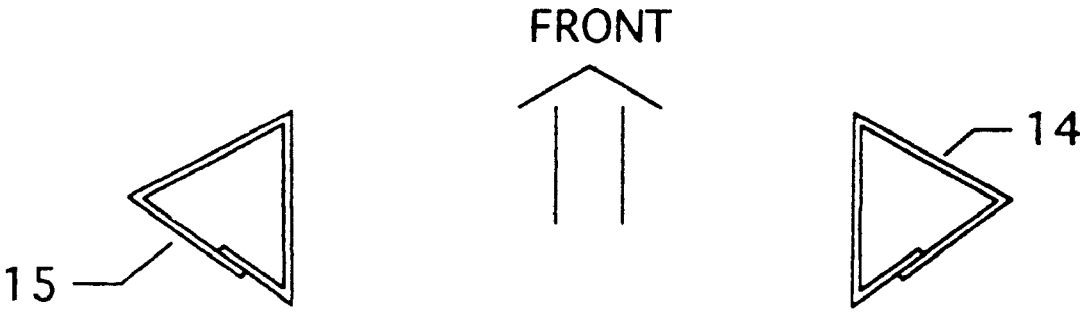
FIG. 9 is a plan view of two assembled end columns showing their position relative to one another in a fully assembled display.

The overall process of assembling the display assembly 11 is now described and is shown generally in FIG. 6A through 6D. Assembly starts with opening the point of sale container 12, unfolding the various fluted plastic sections contained in the box, and assembling the two end columns 14 and 15, the four center sections 23, and the header 19. These steps have previously been described. The next step is to place the two end columns 14 and 15 on end as shown in FIG. 8, which is a view of the end columns 14 and 15 from their back side. One of the end columns is placed with its locking doors 70 pointing upward and the other with its locking doors 70 facing downward as shown in FIG. 8. FIG. 9 is a plan view of the end columns placed as shown in FIG. 8.

Figure 14:
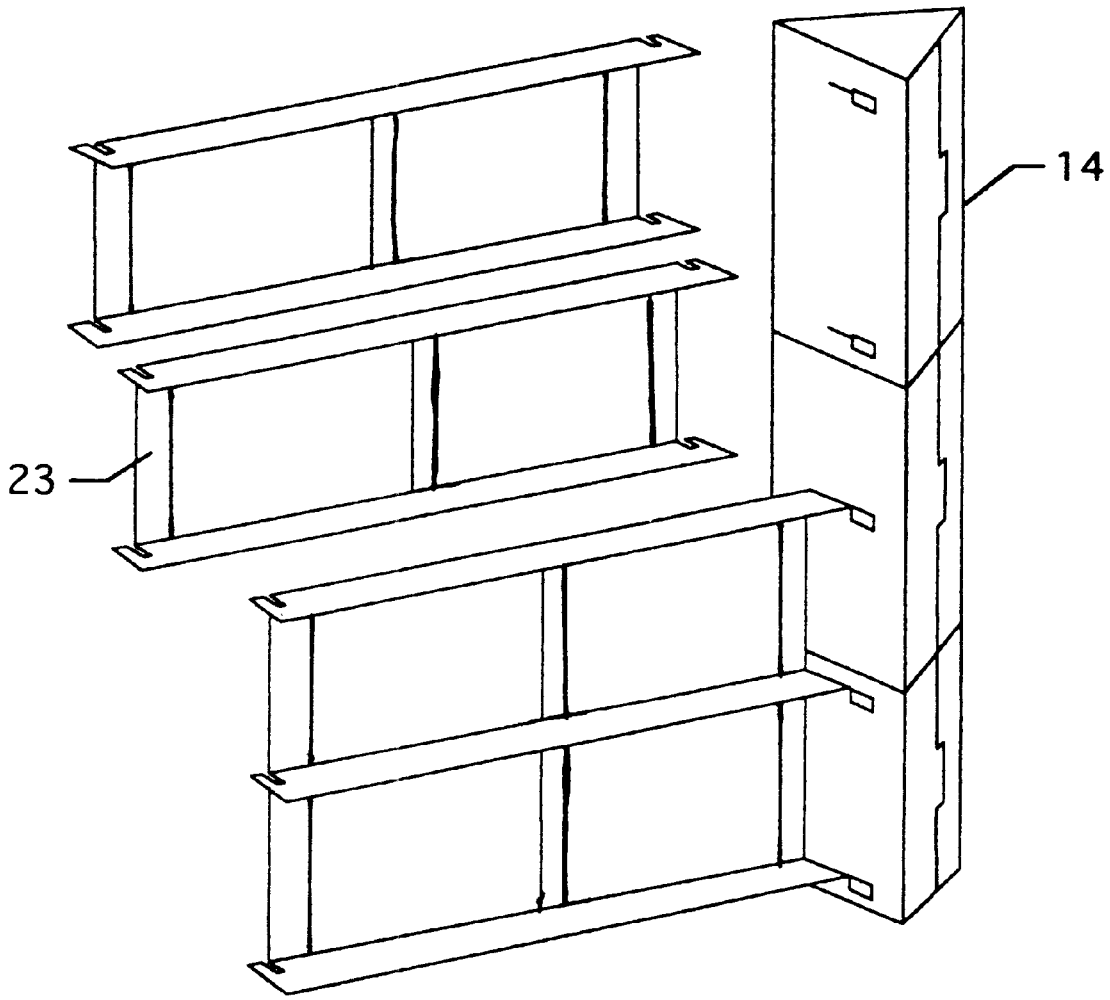
FIG. 14 is a perspective view from the back of the display assembly showing assembly of the four center wall sections to an end column.

The next step consists of inserting all the center sections 23 into both end columns 14 as shown in FIG. 14, which is a view of the display 11 from its back side. For convenience of illustration, only a single end column 14 is shown, but the process is the same for each end column 14. Insertion of the center sections 23 is accomplished by first depressing the locking doors 70 towards the center of the end column 14 or 15 and then inserting the center section end tabs 52 as shown in FIG. 14 into the locking door 70 opening and the locking slots 28. The center section 23 is then slid forward, engaging the end column 14 wall in the center sect ion end tabs 52, flush with the locking door 70 opening, thereby allowing the locking door 70 to swing back to its original closed position to lock the center wall 22 in place.

Figure 18:
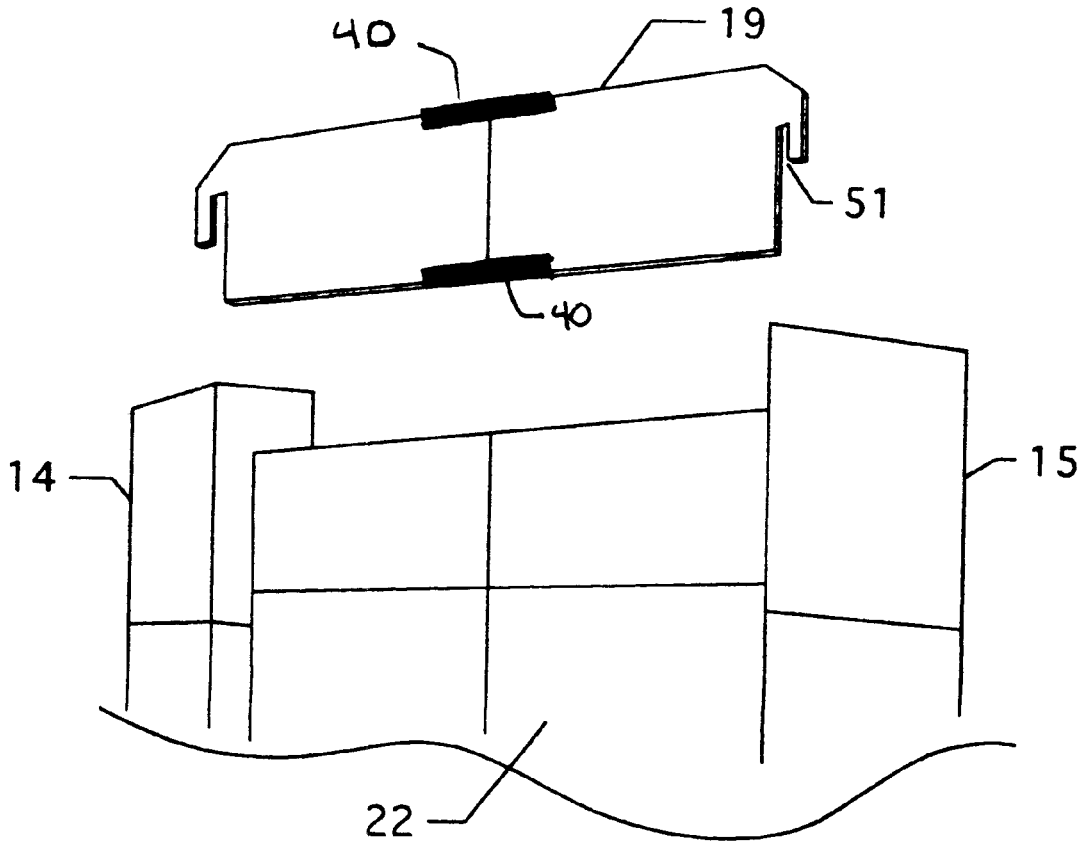
FIG. 18 is a perspective view showing the first stage of assembly of the header to the end columns.
Figure 19:
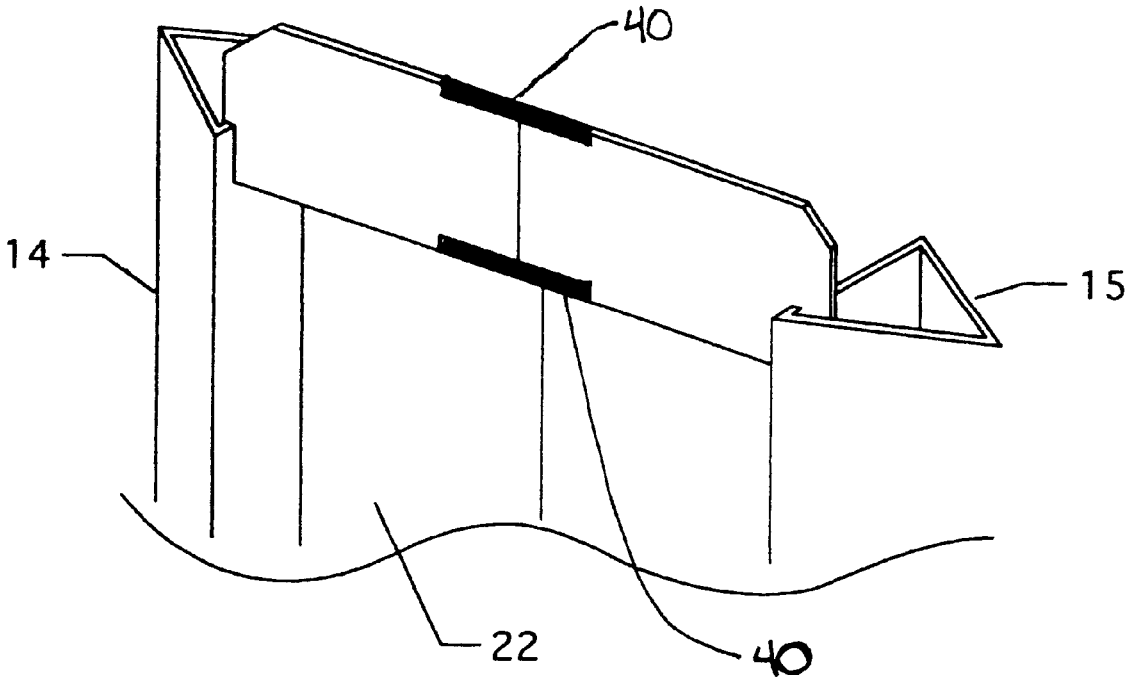
FIG. 19 is a perspective view showing the second stage of assembly of the header to the end columns.

The unfolded header 19 is attached to the end columns 14 and 15 as shown in FIGS. 18 and 19. The header slots 51 are slid onto the end columns 14 and 15 and header slots 51 mate with the wall of the end columns 14 and 15. The header 19 is then pulled forward on the end columns 14 and 15 as far as possible. One or both of the end columns 14 or 15 is rotated toward the center to pinch the header 19 in place. A joint support piece 40 on the top or bottom (or both) of header 19 may be slid over the center crease.

Figure 11:
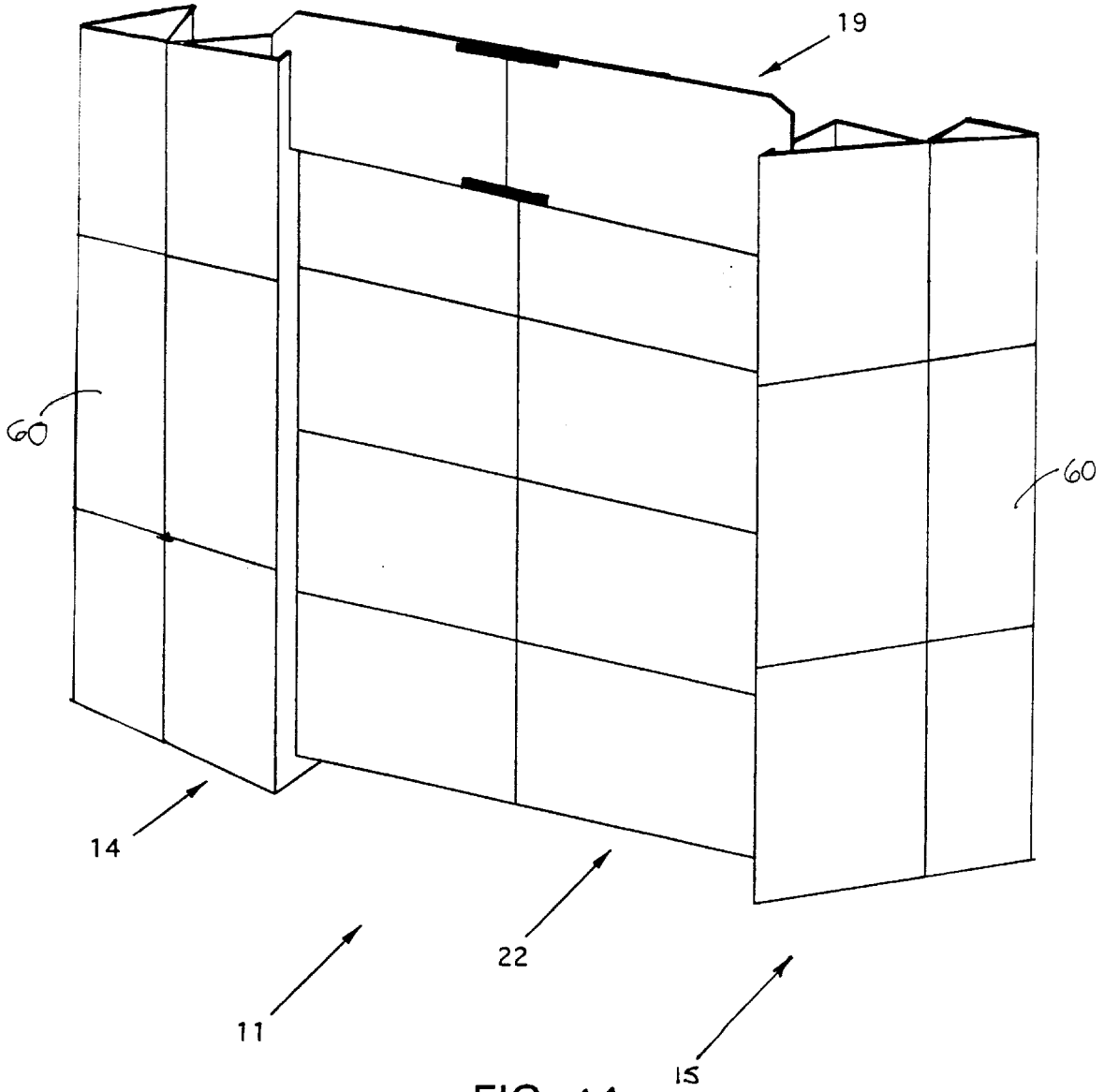
FIG. 11 is a perspective view of the front of the embodiment of FIG. 1, including optional extension columns.

The display assembly 11 may be used as described above, or an extension column 60 may be added to either or both end columns, as illustrated in FIG. 11. Extension columns 60 are useful for increasing the display area of the invention. For example, in a preferred but not mandatory embodiment, two extension columns 60 can be used to increase the total width of display assembly from eight feet to nine and one-half feet. In general, extension columns 60 are upstanding and triangular in cross section, similar to first end column 14 and second end column 15. Extension columns 60 also help stabilize the display assembly 11, and are arranged to extend the area viewable as the display is approached from the side.

Figure 12:
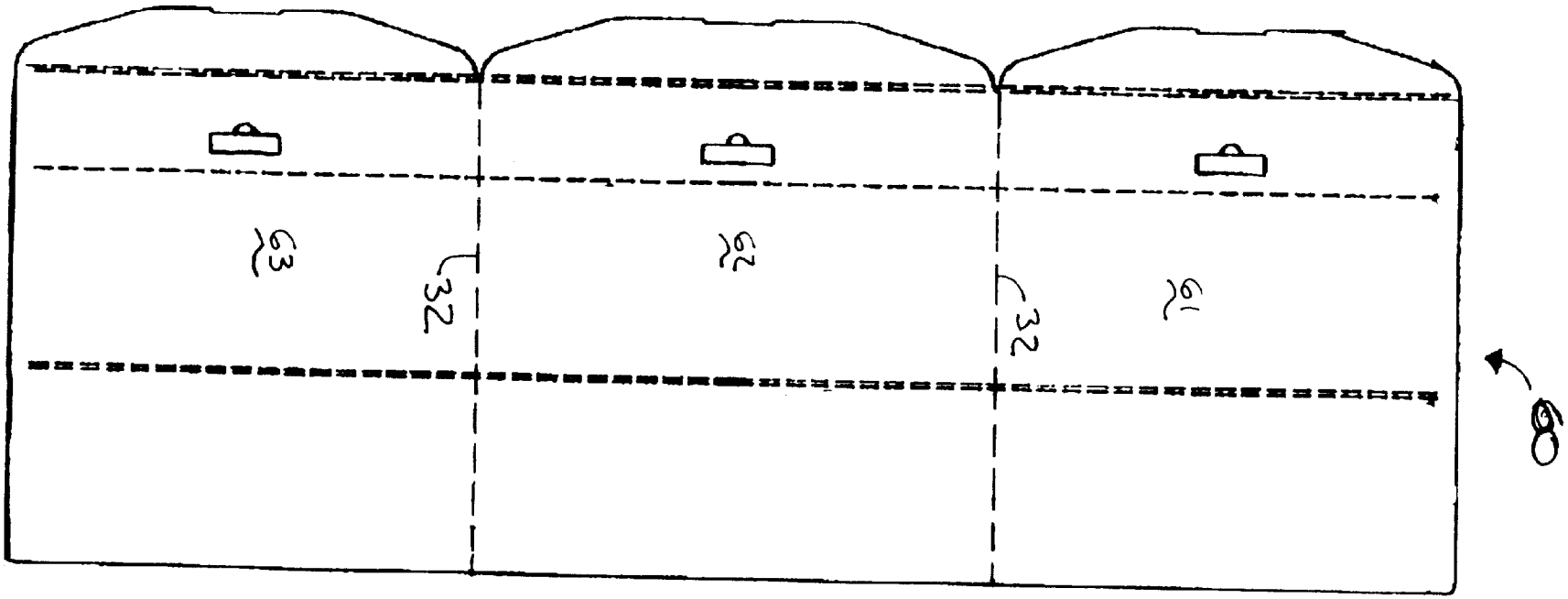
FIG. 12 is a plan view of an unfolded extension column.
Figures 13A, 13B, 13C, 13D:
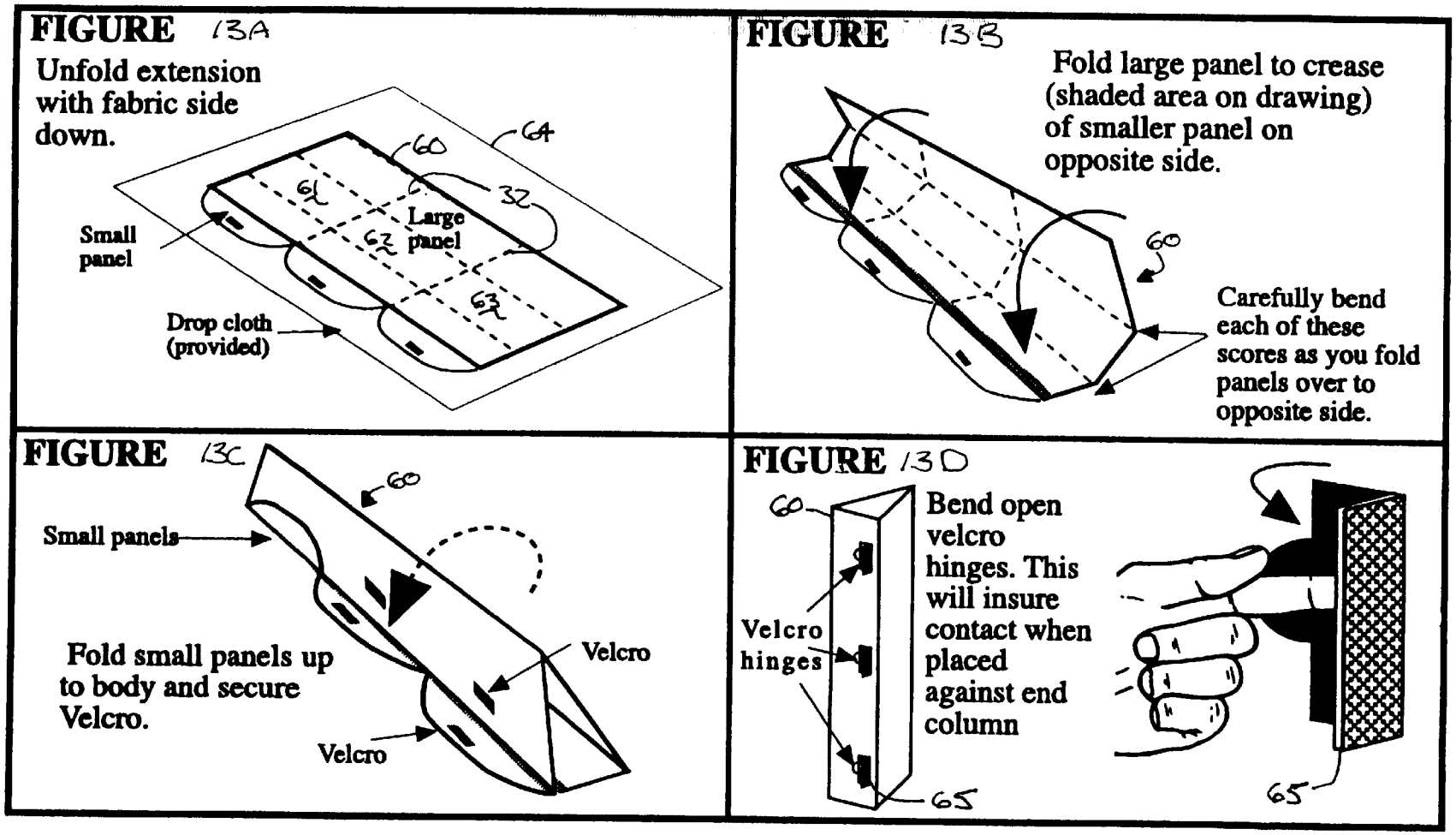
FIGS. 13A–13D are perspective views of the process of assembling an extension column.

FIG. 12 illustrates an extension column 60 in an unfolded flat condition as it is after being die cut, and the sequence of assembling the flat material into an assembled column. Each extension column is a unitary construction having three major sections 61, 62, 63, connected by two integral cut hinges 32. FIGS. 13A–13D illustrate the process of assembling extension column 60. Extension column 60 is taken from its point of sale container and unfolded on a clean floor (or, in the preferred embodiment, a drop cloth 64 provided with the point of sale container to keep the finish side surface clean). The finish side, or exterior side, of the extension column faces downward. The larger panel is folded until it reaches a crease of the smaller panel on the opposite side. Each panel is bent along each of two scores formed in the material during manufacture. Once each small panel is folded to meet the larger panel, hook-and-loop fasteners (commonly sold under the trade name "Velcro") are used to hold column 60 in its assembled shape. The number and exact location of fasteners is not critical to the scope of the invention. To attach extension column 60 to an end column, another set of loop-and-pile fasteners 65 is used. In the preferred embodiment, there are three such pairs, but this is only an example. Each pair comprises a hinged portion of material that has the loop and the pile facing each other within the hinged portion. Thus, by opening the hinge, the individual surfaces may be exposed so that they may mate with corresponding surfaces located on end columns 14 and 15, thus holding extension column 60 in place.

Figure 21:
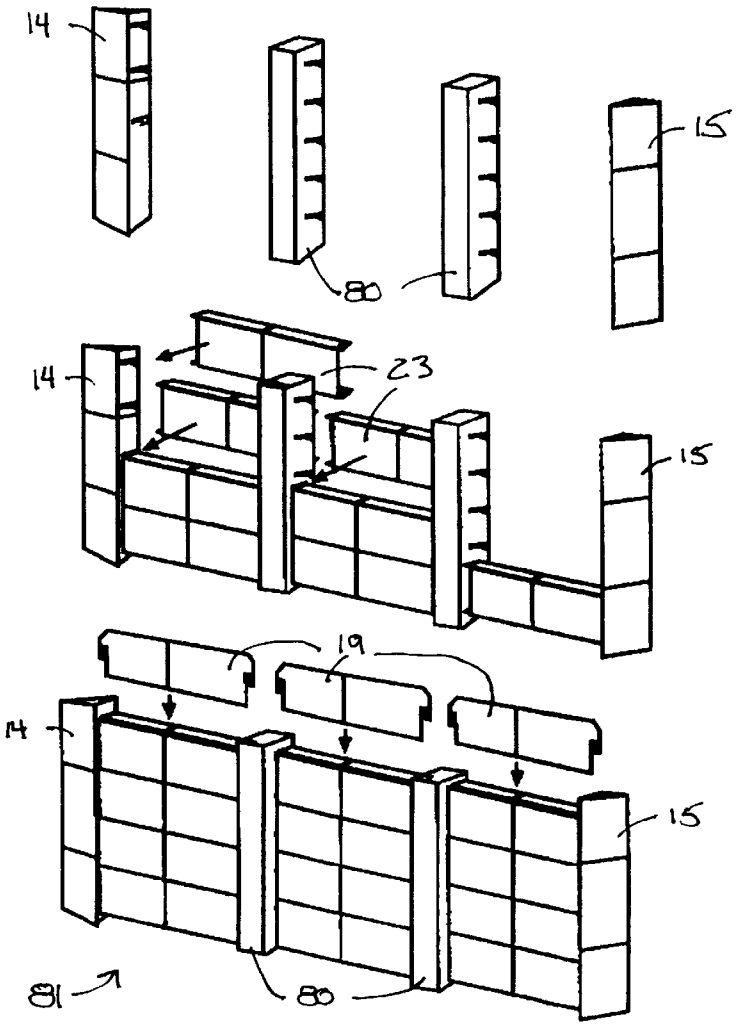
FIG. 21 is a sequence of perspective views showing various stages of assembly of an alternative embodiment of the invention.
Figure 22:
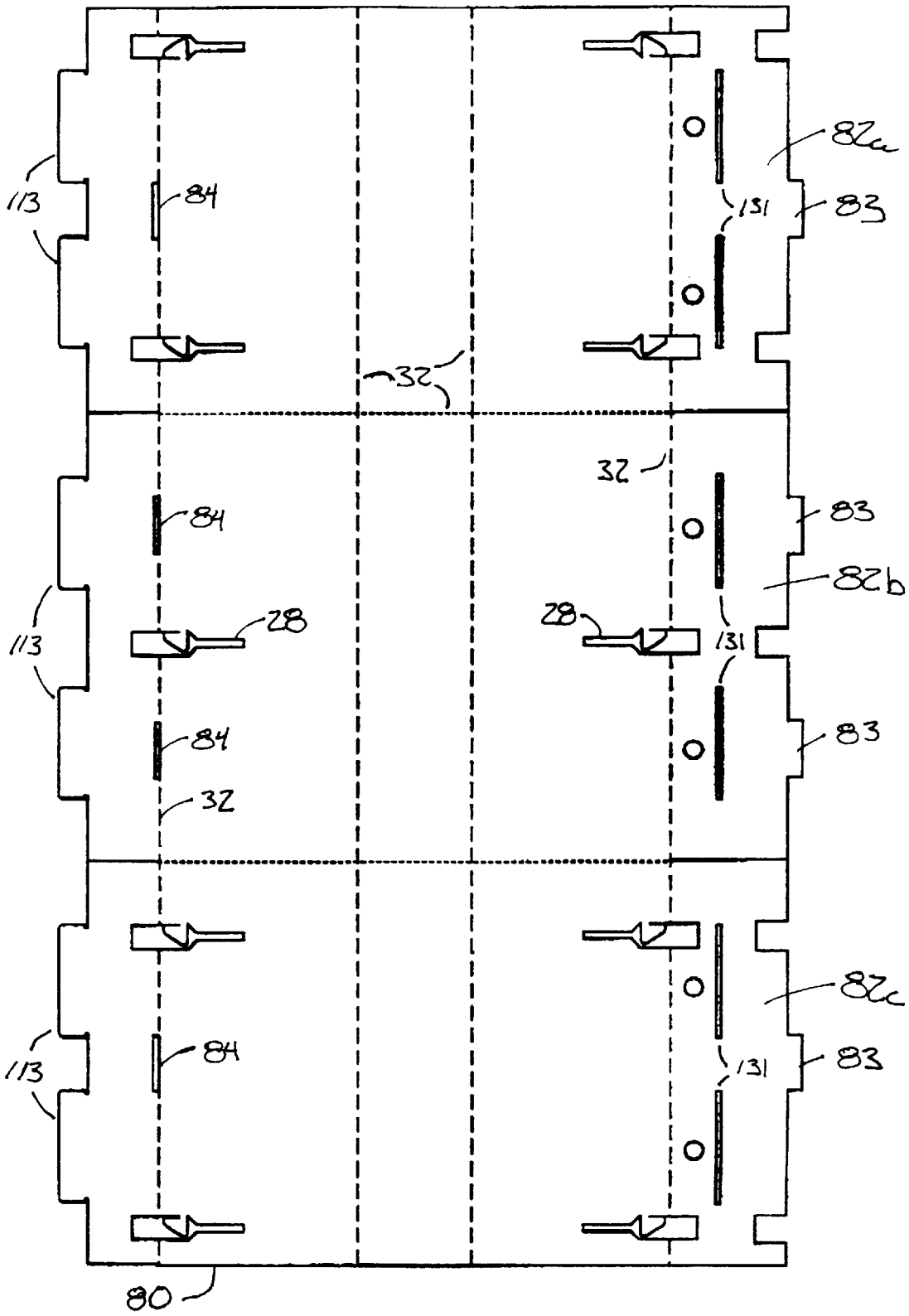
FIG. 22 is a plan view of an unfolded extension column.
Figure 23:
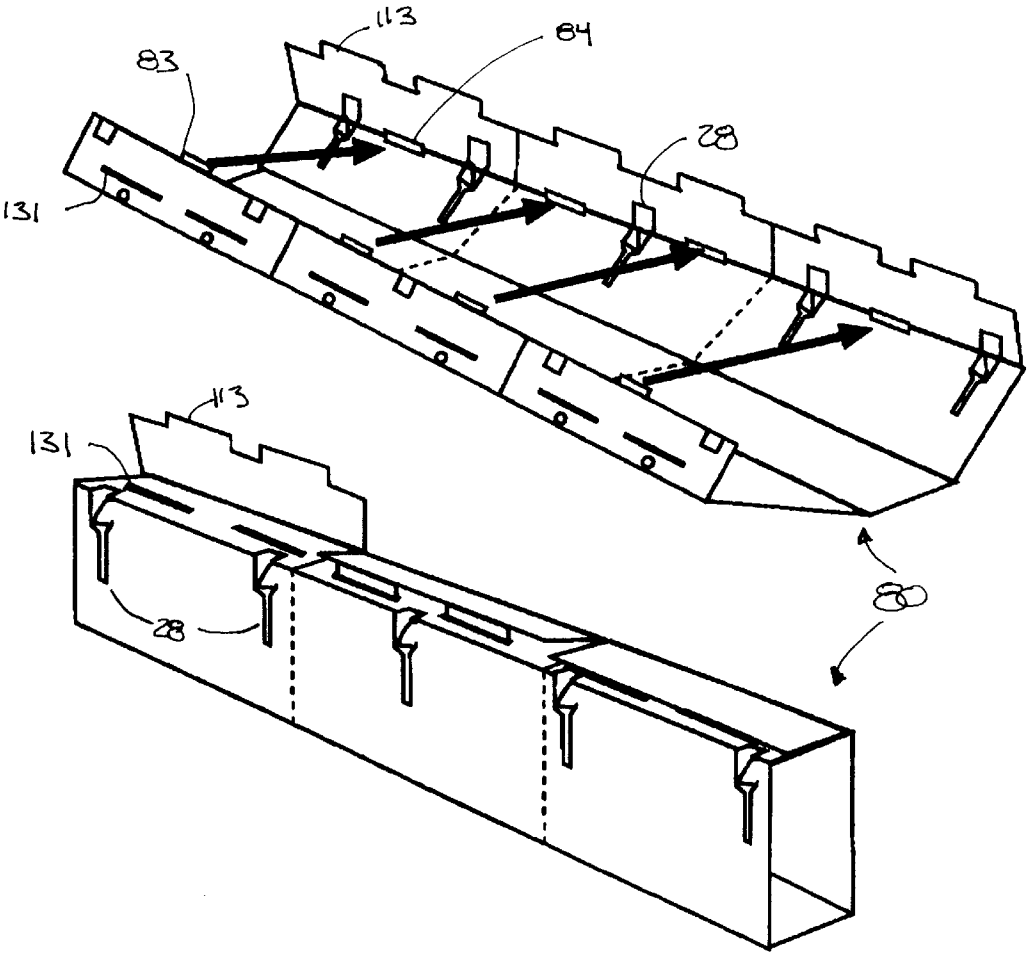
FIG. 23 illustrates the sequence of folding together the extension column of FIG. 22.

FIGS. 21 through 23 illustrate an alternative embodiment of the invention. Many components and features of this embodiment are the same or very similar to the embodiment described above, and therefore the following discussion will focus only on specific differences between the embodiments.

As illustrated in FIG. 21, an extended display assembly 81 comprises first and second end columns 14, 15 as before, but additionally includes at least one middle column 80. As illustrated, two such middle columns 80 are shown, but this is only an example. The number of middle columns 80 is selected as needed to extend the overall size of extended display assembly 81 to the desired amount. As in the previous embodiment, center wall sections 23 are located between the end columns 14, 15 and middle columns 80, and headers 19 are then added t o each respective center section.

FIG. 22 is a plan view of an unfolded middle column 80 analogous to the unfolded end column 14, 15 shown in FIG. 3A. As with end columns 14 and 15, middle column 80 may or may not employ laminated fabric, and thus while FIG. 22 illustrates an embodiment without such fabric, it should be understood that an embodiment using such fabric is within the scope of the invention. However, as FIG. 21 illustrates, the preferred rectangular cross section of middle column 80 (described below) is such that only a narrow width is visible after display assembly 81 is fully assembled. Illuminating the interior of middle column 80, which is possible when the fabric is not employed, would produce a striped appearance that might detract from the visual appeal of display assembly 81 Use of fabric, by contrast, helps present a large and uniformly appearing background that complements the extended size of extended display assembly 81.

Middle column 80 is a unitary construction having three major segments connected by integral cut hinges 32 as described above. Each middle column segment 82*a*, 82*b*, and 82*c* has integrally connected alignment tabs 83 for mating insertion into corresponding alignment slots 84, and engagement tabs 113 for mating engagement with corresponding engagement slots 131. Each middle column 80 has locking slots 28 as described above. By contrast to end columns 14 and 15, there are two opposing sets of locking slots 28 in each middle column 80. Referring again to FIG. 21, middle column 80 must attach to center wall sections 23 on each of its two opposed side faces, as opposed to end columns 14, 15 which attach to center wall sections 23 on only one of their three faces. Otherwise, the number and location of all tabs and slots are not critical to the scope of the invention. Optional hand holds (not shown) may be cutout in the middle column 80 for ease of assembly and carrying.

FIG. 23 illustrates the assembly steps of an middle column 80. As before, a folded middle column 80 is taken from its point of sale container (not shown) and unfolded on a clean floor with the finish side, or exterior side, of the middle column 80 towards the floor. The cut hinges 32 are employed to fold the various sections together as shown. As indicated by the bold arrows, alignment tabs 83 are inserted into alignment slots 84. Engagement tabs 113 are inserted into engagement slots 131 to form a rigid middle column 80. The preferred cross section of middle column 80 is rectangular, but this is only a preference and not a limitation on the scope of the invention.

All references to fluted plastic material should be understood to include either extruded or corrugated plastic materials, the latter of which would be preferred manufacturing in large volumes.

The invention may be embodied in other specific forms. The preferred embodiment shown in the Figures and described above is only an example of the invention, which is fully defined by the following claims.

I claim:

1. A display assembly comprising:

a) first an second fluted plastic end columns;

b) a center wall, comprising a set of fluted plastic sections, disposed between the first and second end columns; and c) a header disposed between the first and second end columns and proximate to the upper portion of the center wall, comprising first and second header panels joined together by a flexible hinge, and at least one support piece to prevent the hinge from pivoting;

in which at least one piece of fluted plastic forming the end columns and the center wall comprises at least two sections defining between themselves a hinge, such that each section may be folded upon itself by the hinge.

2. The display assembly of claim 1, in which at least one end column is translucent fluted plastic material.

3. The display assembly of claim 1, in which at least one end column further comprises fabric laminated to its surface.

4. The display assembly of claim 1, in which the end columns and the center wall are connected by insertion of center section end tabs into corresponding locking slots, and the center section end tabs are locked into the locking slots by a locking door.

5. The display assembly of claim 4, in which the locking door comprises a generally elongated opening in the end column, having an angled tab portion that separates a wider portion of the opening from its respective locking slot.

6. The display assembly of claim 1, in which at least one end column has a triangular cross-section.

7. The display assembly of claim 1, in which at least one center section comprises a vertical rib adhered to the section.

8. The display assembly of claim 1, in which at least one center section comprises a vertical rib integral to the section.

9. The display assembly of claim 1, further comprising at least one extension column.

10. The display assembly of claim 9, in which at least one extension column is translucent fluted plastic material.

11. The display assembly of claim 9, in which at least one extension column further comprises fabric laminated to its surface.

12. The display assembly of claim 9, in which at least one end columns and at least one extension column are connected to each other by hook-and-loop hinges.

13. The display assembly of claim 1, further comprising at least one middle column for extending the size of the display assembly.

14. A display assembly comprising:

a) first and second fluted plastic end columns;

b) at least one fluted plastic middle column;

c) at least two center walls, each comprising a set of fluted plastic sections, each disposed between two of the end and middle columns; and d) at least two headers, each disposed between two columns and each proximate to a respective upper portion of a center wall;

in which at least one piece of fluted plastic forming the end and middle columns and the center wall comprises at least two sections defining between themselves a hinge, such that each section may be folded upon itself by the hinge.

15. The display assembly of claim 14, in which at least one end column is translucent fluted plastic material.

16. The display assembly of claim 14, in which at least one end column further comprises fabric laminated to its surface.

17. The display assembly of claim 14, in which at least one middle column is translucent fluted plastic material.

18. The display assembly of claim 14, in which at least one middle column further comprises fabric laminated to its surface.

19. The display assembly of claim 14, in which the end and middle columns and the center walls are connected by insertion of center section end tabs into corresponding locking slots, and the center section end tabs are locked into the locking slots by a locking door.

20. The display assembly of claim 19, in which the locking door comprises a generally elongated opening in the column, having an angled tab portion that separates a wider portion of the opening from its respective locking slot.

21. The display assembly of claim 14, in which at least one end column has a triangular cross-section.

22. The display assembly of claim 14, in which at least one middle column has a rectangular cross-section.

23. The display assembly of claim 14, in which the header comprises first and second header panels joined together by a flexible hinge, and at least one support piece to prevent the hinge from pivoting.

24. The display assembly of claim 14, in which at least one center section comprises a vertical rib adhered to the section.

25. The display assembly of claim 14, in which at least one center section comprises a vertical rib integral to the section.

26. The display assembly of claim 14, further comprising at least one extension column.

27. The display assembly of claim 26, in which at least one extension column is translucent fluted plastic material.

28. The display assembly of claim 26, in which at least one extension column further comprises fabric laminated to its surface.

29. The display assembly of claim 26, in which at least one end column and at least one extension column are connected to each other by hook-and-loop hinges.

30. A display assembly comprising:

a) first and second fluted plastic end columns;

b) a center wall, comprising a set of fluted plastic sections, disposed between the first and second end columns; and c) a header disposed between the first and second end columns and proximate to the upper portion of the center wall;

d) at least one extension column;

in which at least one piece of fluted plastic forming the end columns and the center wall comprises at least two sections defining between themselves a hinge, such that each section may be folded upon itself by the hinge.

31. The display assembly of claim 30, in which at least one end column is translucent fluted plastic material.

32. The display assembly of claim 30, in which at least one end column further comprises fabric laminated to its surface.

33. The display assembly of claim 30, in which at least one end column further connected by insertion of center section end tabs into corresponding locking slots, and the center section end tabs are locked into the locking slots by a locking door.

34. The display assembly of claim 33, in which the locking door comprises a generally elongated opening in the column, having an angled tab portion that separates a wider portion of the opening from its respective locking slot.

35. The display assembly of claim 30, in which at least one end column has a triangular cross-section.

36. The display assembly of claim 30, in which the header comprises first and second header panels joined together by flexible hinge, and at least one support piece to prevent the hinge from pivoting.

37. The display assembly of claim 30, in which at least one center section comprises a vertical rib laminated to the section.

38. The display assembly of claim 30, in which at least one center section comprises a vertical rib integral to the section.

39. The display assembly of claim 30, in which at least one extension column is translucent fluted plastic material.

40. The display assembly of claim 30, in which at least one extension column further comprises fabric adhered to its surface.

41. The display assembly of claim 30, in which at least one end columns and at least one extension column are connected to each other by hook-and-loop hinges.

42. The display assembly of claim 30, further comprising at least one middle column for extending the size of the display assembly.

43. A display assembly comprising:

a) first and second fluted plastic end columns;

b) a center wall, comprising a set of fluted plastic sections, disposed between the first and second end columns; and c) a header disposed between the first and second and column end columns and proximate to the upper portion of the center wall;

d) at least one middle column for extending the size of the display assembly; in which at least one piece of fluted plastic forming the end columns and the center wall comprises at least two sections defining between themselves a hinge, such that each section may be folded upon itself by the hinge.

44. The display assembly of claim 43, in which at least one end column is translucent fluted plastic material.

45. The display assembly of claim 43, in which at least one end column further comprises fabric laminated to its surface.

46. The display assembly of claim 43, in which the end columns and the center wall are connected by insertion of center section end tabs into corresponding locking slots, and the center section end tabs are locked into the locking slots by a locking door.

47. The display assembly of claim 46, in which the locking door comprises a generally elongated opening in the end column, having an angled tab portion that separates a wider portion of the opening from its respective locking slot.

48. The display assembly of claim 43, in which at least one end column has a triangular cross-section.

49. The display assembly of claim 43, in which the header comprises first and second header panels joined together by a flexible hinge, and at least one support piece to prevent the hinge from pivoting.

50. The display assembly of claim 43, in which at least one center section comprises a vertical rib laminated to the section.

51. The display assembly of claim 43, in which at least one center section comprises a vertical rib integral to the section.

52. The display assembly of claim 43, further comprising at least one extension column.

53. The display assembly of claim 52, in which at least one extension column is translucent fluted plastic material.

54. The display assembly of claim 52, in which at least one extension column further comprises fabric laminated to its surface.

55. The display assembly of claim 52, in which at least one end columns and at least one extension column are connected to each other by hook-and-loop hinges.

* * * * *